US010711540B2

(12) United States Patent
Holand et al.

(10) Patent No.: US 10,711,540 B2
(45) Date of Patent: Jul. 14, 2020

(54) CATWALK AND CRANE SYSTEM

(71) Applicant: CAMERON TECHNOLOGIES LIMITED, Houston, TX (US)

(72) Inventors: Max Holand, Kristiansand (NO); Joe Rodney Berry, Cypress, TX (US); Kristian Tindvik, Kristiansand (NO)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/094,865

(22) PCT Filed: May 2, 2017

(86) PCT No.: PCT/US2017/030562
§ 371 (c)(1),
(2) Date: Oct. 18, 2018

(87) PCT Pub. No.: WO2017/192531
PCT Pub. Date: Nov. 9, 2017

(65) Prior Publication Data

US 2019/0128077 A1 May 2, 2019

Related U.S. Application Data

(60) Provisional application No. 62/330,721, filed on May 2, 2016.

(51) Int. Cl.

| | |
|---|---|
| ***E21B 19/15*** | (2006.01) |
| ***E21B 41/00*** | (2006.01) |
| ***E21B 19/00*** | (2006.01) |

(52) U.S. Cl.
CPC ..... *E21B 19/155* (2013.01); *E21B 19/008* (2013.01); *E21B 41/00* (2013.01)

(58) Field of Classification Search
CPC ..... E21B 19/155; E21B 19/008; E21B 41/00; E21B 7/02; E21B 19/15; E21B 19/14; E21B 19/20
USPC ..... 414/22.51–22.71
See application file for complete search history.

(56) References Cited

U.S. PATENT DOCUMENTS 3,534,867 A 10/1970 Johnston et al.
4,108,317 A * 8/1978 Bifani ..... B66C 23/74 212/195
4,407,629 A * 10/1983 Willis ..... E21B 19/155 175/52

(Continued)

OTHER PUBLICATIONS

International Preliminary Report on Patentability for the equivalent International patent application PCT/US2017/030562 dated Nov. 15, 2018.

(Continued)

*Primary Examiner* — Lynn E Schwenning
(74) *Attorney, Agent, or Firm* — Helene Raybaud

(57) ABSTRACT

A catwalk and crane system for transporting equipment of a well system includes a substructure, a directing frame pivotally coupled to the substructure, a pipe transporter configured to transport a tubular along the directing frame, a first actuator coupled to the directing frame and configured to rotate the directing frame relative to the substructure, and a crane coupled to the directing frame, wherein the crane is extendable from a first end of the directing frame.

20 Claims, 14 Drawing Sheets

(56) References Cited

U.S. PATENT DOCUMENTS

| | | | | |
|---|---|---|---|---|
| 6,695,559 | B1 * | 2/2004 | Pietras | E21B 19/00 414/22.57 |
| 8,033,779 | B2 * | 10/2011 | Gerber | E21B 19/15 14/71.1 |
| 2006/0045653 | A1 * | 3/2006 | Guidry | B66C 1/10 414/22.51 |
| 2009/0159294 | A1 * | 6/2009 | Abdollahi | E21B 19/14 166/377 |
| 2010/0307401 | A1 | 12/2010 | Bereznitski et al. | |
| 2011/0044787 | A1 | 2/2011 | Fikowski et al. | |
| 2011/0070054 | A1 | 3/2011 | Crossley et al. | |
| 2011/0188973 | A1 * | 8/2011 | Baumler | E21B 19/08 414/22.57 |
| 2012/0027541 | A1 | 2/2012 | Gerber et al. | |
| 2012/0121364 | A1 | 5/2012 | Taggart et al. | |
| 2017/0044852 | A1 * | 2/2017 | Pover | E21B 19/155 |

OTHER PUBLICATIONS

International Search Report and Written Opinion for the equivalent International patent application PCT/US2017/030562 dated Jul. 26, 2017.

* cited by examiner

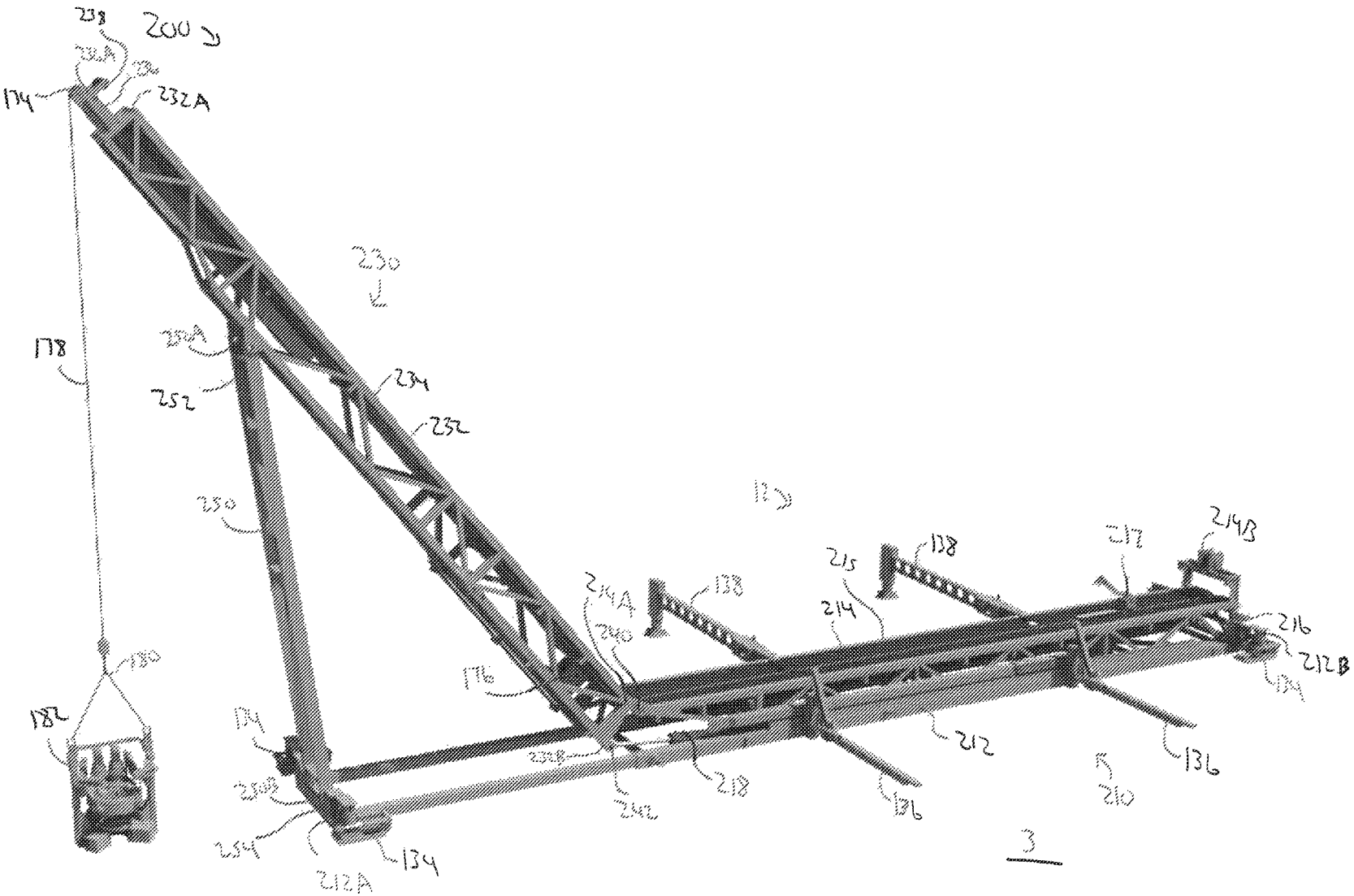
200
232A
232
234
252
252A
230
250
178
178A
178B
178C
178D
178E
178F
178G
178H
178I
178J
178K
178L
178M
178N
178O
178P
178Q
178R
178S
178T
178U
178V
178W
178X
178Y
178Z
178AA
178AB
178AC
178AD
178AE
178AF
178AG
178AH
178AI
178AJ
178AK
178AL
178AM
178AN
178AO
178AP
178AQ
178AR
178AS
178AT
178AU
178AV
178AW
178AX
178AY
178AZ
178BA
178BB
178BC
178BD
178BE
178BF
178BG
178BH
178BI
178BJ
178BK
178BL
178BM
178BN
178BO
178BP
178BQ
178BR
178BS
178BT
178BU
178BV
178BW
178BX
178BY
178BZ
178CA
178CB
178CC
178CD
178CE
178CF
178CG
178CH
178CI
178CJ
178CK
178CL
178CM
178CN
178CO
178CP
178CQ
178CR
178CS
178CT
178CU
178CV
178CW
178CX
178CY
178CZ
178DA
178DB
178DC
178DD
178DE
178DF
178DG
178DH
178DI
178DJ
178DK
178DL
178DM
178DN
178DO
178DP
178DQ
178DR
178DS
178DT
178DU
178DV
178DW
178DX
178DY
178DZ
178EA
178EB
178EC
178ED
178EE
178EF
178EG
178EH
178EI
178EJ
178EK
178EL
178EM
178EN
178EO
178EP
178EQ
178ER
178ES
178ET
178EU
178EV
178EW
178EX
178EY
178EZ
178FA
178FB
178FC
178FD
178FE
178FF
178FG
178FH
178FI
178FJ
178FK
178FL
178FM
178FN
178FO
178FP
178FQ
178FR
178FS
178FT
178FU
178FV
178FW
178FX
178FY
178FZ
178GA
178GB
178GC
178GD
178GE
178GF
178GG
178GH
178GI
178GJ
178GK
178GL
178GM
178GN
178GO
178GP
178GQ
178GR
178GS
178GT
178GU
178GV
178GW
178GX
178GY
178GZ
178HA
178HB
178HC
178HD
178HE
178HF
178HG
178HH
178HI
178HJ
178HK
178HL
178HM
178HN
178HO
178HP
178HQ
178HR
178HS
178HT
178HU
178HV
178HW
178HX
178HY
178HZ
178IA
178IB
178IC
178ID
178IE
178IF
178IG
178IH
178II
178IJ
178IK
178IL
178IM
178IN
178IO
178IP
178IQ
178IR
178IS
178IT
178IU
178IV
178IW
178IX
178IY
178IZ
178JA
178JB
178JC
178JD
178JE
178JF
178JG
178JH
178JI
178JJ
178JK
178JL
178JM
178JN
178JO
178JP
178JQ
178JR
178JS
178JT
178JU
178JV
178JW
178JX
178JY
178JZ
178KA
178KB
178KC
178KD
178KE
178KF
178KG
178KH
178KI
178KJ
178KK
178KL
178KM
178KN
178KO
178KP
178KQ
178KR
178KS
178KT
178KU
178KV
178KW
178KX
178KY
178KZ
178LA
178LB
178LC
178LD
178LE
178LF
178LG
178LH
178LI
178LJ
178LK
178LL
178LM
178LN
178LO
178LP
178LQ
178LR
178LS
178LT
178LU
178LV
178LW
178LX
178LY
178LZ
178MA
178MB
178MC
178MD
178ME
178MF
178MG
178MH
178MI
178MJ
178MK
178ML
178MM
178MN
178MO
178MP
178MQ
178MR
178MS
178MT
178MU
178MV
178MW
178MX
178MY
178MZ
178NA
178NB
178NC
178ND
178NE
178NF
178NG
178NH
178NI
178NJ
178NK
178NL
178NM
178NN
178NO
178NP
178NQ
178NR
178NS
178NT
178NU
178NV
178NW
178NX
178NY
178NZ
178OA
178OB
178OC
178OD
178OE
178OF
178OG
178OH
178OI
178OJ
178OK
178OL
178OM
178ON
178OO
178OP
178OQ
178OR
178OS
178OT
178OU
178OV
178OW
178OX
178OY
178OZ
178PA
178PB
178PC
178PD
178PE
178PF
178PG
178PH
178PI
178PJ
178PK
178PL
178PM
178PN
178PO
178PP
178PQ
178PR
178PS
178PT
178PU
178PV
178PW
178PX
178PY
178PZ
178QA
178QB
178QC
178QD
178QE
178QF
178QG
178QH
178QI
178QJ
178QK
178QL
178QM
178QN
178QO
178QP
178QQ
178QR
178QS
178QT
178QU
178QV
178QW
178QX
178QY
178QZ
178RA
178RB
178RC
178RD
178RE
178RF
178RG
178RH
178RI
178RJ
178RK
178RL
178RM
178RN
178RO
178RP
178RQ
178RR
178RS
178RT
178RU
178RV
178RW
178RX
178RY
178RZ
178SA
178SB
178SC
178SD
178SE
178SF
178SG
178SH
178SI
178SJ
178SK
178SL
178SM
178SN
178SO
178SP
178SQ
178SR
178SS
178ST
178SU
178SV
178SW
178SX
178SY
178SZ
178TA
178TB
178TC
178TD
178TE
178TF
178TG
178TH
178TI
178TJ
178TK
178TL
178TM
178TN
178TO
178TP
178TQ
178TR
178TS
178TT
178TU
178TV
178TW
178TX
178TY
178TZ
178UA
178UB
178UC
178UD
178UE
178UF
178UG
178UH
178UI
178UJ
178UK
178UL
178UM
178UN
178UO
178UP
178UQ
178UR
178US
178UT
178UU
178UV
178UW
178UX
178UY
178UZ
178VA
178VB
178VC
178VD
178VE
178VF
178VG
178VH
178VI
178VJ
178VK
178VL
178VM
178VN
178VO
178VP
178VQ
178VR
178VS
178VT
178VU
178VV
178VW
178VX
178VY
178VZ
178WA
178WB
178WC
178WD
178WE
178WF
178WG
178WH
178WI
178WJ
178WK
178WL
178WM
178WN
178WO
178WP
178WQ
178WR
178WS
178WT
178WU
178WV
178WW
178WX
178WY
178WZ
178XA
178XB
178XC
178XD
178XE
178XF
178XG
178XH
178XI
178XJ
178XK
178XL
178XM
178XN
178XO
178XP
178XQ
178XR
178XS
178XT
178XU
178XV
178XW
178XX
178XY
178XZ
178YA
178YB
178YC
178YD
178YE
178YF
178YG
178YH
178YI
178YJ
178YK
178YL
178YM
178YN
178YO
178YP
178YQ
178YR
178YS
178YT
178YU
178YV
178YW
178YX
178YY
178YZ
178ZA
178ZB
178ZC
178ZD
178ZE
178ZF
178ZG
178ZH
178ZI
178ZJ
178ZK
178ZL
178ZM
178ZN
178ZO
178ZP
178ZQ
178ZR
178ZS
178ZT
178ZU
178ZV
178ZW
178ZX
178ZY
178ZZ
178AAA
178AAB
178AAC
178AAD
178AAE
178AAF
178AAG
178AAH
178AAI
178AAJ
178AAK
178AAL
178AAM
178AAN
178AAO
178AAP
178AAQ
178AAR
178AAS
178AAT
178AAU
178AAV
178AAW
178AAX
178AAY
178AAZ
178ABA
178ABB
178ABC
178ABD
178ABE
178ABF
178ABG
178ABH
178ABI
178ABJ
178ABK
178ABL
178ABM
178ABN
178ABO
178ABP
178ABQ
178ABR
178ABS
178ABT
178ABU
178ABV
178ABW
178ABX
178ABY
178ABZ
178ACA
178ACB
178ACC
178ACD
178ACE
178ACF
178ACG
178ACH
178ACI
178ACJ
178ACK
178ACL
178ACM
178ACN
178ACO
178ACP
178ACQ
178ACR
178ACS
178ACT
178ACU
178ACV
178ACW
178ACX
178ACY
178ACZ
178ADA
178ADB
178ADC
178ADD
178ADE
178ADF
178ADG
178ADH
178ADI
178ADJ
178ADK
178ADL
178ADM
178ADN
178ADO
178ADP
178ADQ
178ADR
178ADS
178ADT
178ADU
178ADV
178ADW
178ADX
178ADY
178ADZ
178AEA
178AEB
178AEC
178AED
178AEE
178AEF
178AEG
178AEH
178AEI
178AEJ
178AEK
178AEL
178AEM
178AEN
178AEO
178AEP
178AEQ
178AER
178AES
178AET
178AEU
178AEV
178AEW
178AEX
178AEY
178AEZ
178AFA
178AFB
178AFC
178AFD
178AFE
178AFF
178AFG
178AFH
178AFI
178AFJ
178AFK
178AFL
178AFM
178AFN
178AFO
178AFP
178AFQ
178AFR
178AFS
178AFT
178AFU
178AFV
178AFW
178AFX
178AFY
178AFZ
178AGA
178AGB
178AGC
178AGD
178AGE
178AGF
178AGG
178AGH
178AGI
178AGJ
178AGK
178AGL
178AGM
178AGN
178AGO
178AGP
178AGQ
178AGR
178AGS
178AGT
178AGU
178AGV
178AGW
178AGX
178AGY
178AGZ
178AHA
178AHB
178AHC
178AHD
178AHE
178AHF
178AHG
178AHH
178AHI
178AHJ
178AHK
178AHL
178AHM
178AHN
178AHO
178AHP
178AHQ
178AHR
178AHS
178AHT
178AHU
178AHV
178AHW
178AHX
178AHY
178AHZ
178AIA
178AIB
178AIC
178AID
178AIE
178AIF
178AIG
178AIH
178AII
178AIJ
178AIK
178AIL
178AIM
178AIN
178AIO
178AIP
178AIQ
178AIR
178AIS
178AIT
178AIU
178AIV
178AIW
178AIX
178AIY
178AIZ
178AJA
178AJB
178AJC
178AJD
178AJE
178AJF
178AJG
178AJH
178AJI
178AJJ
178AJK
178AJL
178AJM
178AJN
178AJO
178AJP
178AJQ
178AJR
178AJS
178AJT
178AJU
178AJV
178AJW
178AJX
178AJY
178AJZ
178AKA
178AKB
178AKC
178AKD
178AKE
178AKF
178AKG
178AKH
178AKI
178AKJ
178AKK
178AKL
178AKM
178AKN
178AKO
178AKP
178AKQ
178AKR
178AKS
178AKT
178AKU
178AKV
178AKW
178AKX
178AKY
178AKZ
178ALA
178ALB
178ALC
178ALD
178ALE
178ALF
178ALG
178ALH
178ALI
178ALJ
178ALK
178ALL
178ALM
178ALN
178ALO
178ALP
178ALQ
178ALR
178ALS
178ALT
178ALU
178ALV
178ALW
178ALX
178ALY
178ALZ
178AMA
178AMB
178AMC
178AMD
178AME
178AMF
178AMG
178AMH
178AMI
178AMJ
178AMK
178AML
178AMM
178AMN
178AMO
178AMP
178AMQ
178AMR
178AMS
178AMT
178AMU
178AMV
178AMW
178AMX
178AMY
178AMZ
178ANA
178ANB
178ANC
178AND
178ANE
178ANF
178ANG
178ANH
178ANI
178ANJ
178ANK
178ANL
178ANM
178ANN
178ANO
178ANP
178ANQ
178ANR
178ANS
178ANT
178ANU
178ANV
178ANW
178ANX
178ANY
178ANZ
178AOA
178AOB
178AOC
178AOD
178AOE
178AOF
178AOG
178AOH
178AOI
178AOJ
178AOK
178AOL
178AOM
178AON
178AOO
178AOP
178AOQ
178AOR
178AOS
178AOT
178AOU
178AOV
178AOW
178AOX
178AOY
178AOZ
178APA
178APB
178APC
178APD
178APE
178APF
178APG
178APH
178API
178APJ
178APK
178APL
178APM
178APN
178APO
178APP
178APQ
178APR
178APS
178APT
178APU
178APV
178APW
178APX
178APY
178APZ
178AQA
178AQB
178AQC
178AQD
178AQE
178AQF
178AQG
178AQH
178AQI
178AQJ
178AQK
178AQL
178AQM
178AQN
178AQO
178AQP
178AQQ
178AQR
178AQS
178AQT
178AQU
178AQV
178AQW
178AQX
178AQY
178AQZ
178ARA
178ARB
178ARC
178ARD
178ARE
178ARF
178ARG
178ARH
178ARI
178ARJ
178ARK
178ARL
178ARM
178ARN
178ARO
178ARP
178ARQ
178ARR
178ARS
178ART
178ARU
178ARV
178ARW
178ARX
178ARY
178ARZ
178ASA
178ASB
178ASC
178ASD
178ASE
178ASF
178ASG
178ASH
178ASI
178ASJ
178ASK
178ASL
178ASM
178ASN
178ASO
178ASP
178ASQ
178ASR
178ASS
178AST
178ASU
178ASV
178ASW
178ASX
178ASY
178ASZ
178ATA
178ATB
178ATC
178ATD
178ATE
178ATF
178ATG
178ATH
178ATI
178ATJ
178ATK
178ATL
178ATM
178ATN
178ATO
178ATP
178ATQ
178ATR
178ATS
178ATT
178ATU
178ATV
178ATW
178ATX
178ATY
178ATZ
178AUA
178AUB
178AUC
178AUD
178AUE
178AUF
178AUG
178AUH
178AUI
178AUJ
178AUK
178AUL
178AUM
178AUN
178AUO
178AUP
178AUQ
178AUR
178AUS
178AUT
178AUU
178AUV
178AUW
178AUX
178AUY
178AUZ
178AVA
178AVB
178AVC
178AVD
178AVE
178AVF
178AVG
178AVH
178AVI
178AVJ
178AVK
178AVL
178AVM
178AVN
178AVO
178AVP
178AVQ
178AVR
178AVS
178AVT
178AVU
178AVV
178AVW
178AVX
178AVY
178AVZ
178AWA
178AWB
178AWC
178AWD
178AWE
178AWF
178AWG
178AWH
178AWI
178AWJ
178AWK
178AWL
178AWM
178AWN
178AWO
178AWP
178AWQ
178AWR
178AWS
178AWT
178AWU
178AWV
178AWW
178AWX
178AWY
178AWZ
178AXA
178AXB
178AXC
178AXD
178AXE
178AXF
178AXG
178AXH
178AXI
178AXJ
178AXK
178AXL
178AXM
178AXN
178AXO
178AXP
178AXQ
178AXR
178AXS
178AXT
178AXU
178AXV
178AXW
178AXX
178AXY
178AXZ
178AYA
178AYB
178AYC
178AYD
178AYE
178AYF
178AYG
178AYH
178AYI
178AYJ
178AYK
178AYL
178AYM
178AYN
178AYO
178AYP
178AYQ
178AYR
178AYS
178AYT
178AYU
178AYV
178AYW
178AYX
178AYY
178AYZ
178AZA
178AZB
178AZC
178AZD
178AZE
178AZF
178AZG
178AZH
178AZI
178AZJ
178AZK
178AZL
178AZM
178AZN
178AZO
178AZP
178AZQ
178AZR
178AZS
178AZT
178AZU
178AZV
178AZW
178AZX
178AZY
178AZZ
178BAA
178BAB
178BAC
178BAD
178BAE
178BAF
178BAG
178BAH
178BAI
178BAJ
178BAK
178BAL
178BAM
178BAN
178BAO
178BAP
178BAQ
178BAR
178BAS
178BAT
178BAU
178BAV
178BAW
178BAX
178BAY
178BAZ
178BBA
178BBB
178BBC
178BBD
178BBE
178BBF
178BBG
178BBH
178BBI
178BBJ
178BBK
178BBL
178BBM
178BBN
178BBO
178BBP
178BBQ
178BBR
178BBS
178BBT
178BBU
178BBV
178BBW
178BBX
178BBY
178BBZ
178BCA
178BCB
178BCC
178BCD
178BCE
178BCF
178BCG
178BCH
178BCI
178BCJ
178BCK
178BCL
178BCM
178BCN
178BCO
178BCP
178BCQ
178BCR
178BCS
178BCT
178BCU
178BCV
178BCW
178BCX
178BCY
178BCZ
178BDA
178BDB
178BDC
178BDD
178BDE
178BDF
178BDG
178BDH
178BDI
178BDJ
178BDK
178BDL
178BDM
178BDN
178BDO
178BDP
178BDQ
178BDR
178BDS
178BDT
178BDU
178BDV
178BDW
178BDX
178BDY
178BDZ
178BEA
178BEB
178BEC
178BED
178BEE
178BEF
178BEG
178BEH
178BEI
178BEJ
178BEK
178BEL
178BEM
178BEN
178BEO
178BEP
178BEQ
178BER
178BES
178BET
178BEU
178BEV
178BEW
178BEX
178BEY
178BEZ
178BFA
178BFB
178BFC
178BFD
178BFE
178BFF
178BFG
178BFH
178BFI
178BFJ
178BFK
178BFL
178BFM
178BFN
178BFO
178BFP
178BFQ
178BFR
178BFS
178BFT
178BFU
178BFV
178BFW
178BFX
178BFY
178BFZ
178BGA
178BGB
178BGC
178BGD
178BGE
178BGF
178BGG
178BGH
178BGI
178BGJ
178BGK
178BGL
178BGM
178BGN
178BGO
178BGP
178BGQ
178BGR
178BGS
178BGT
178BGU
178BGV
178BGW
178BGX
178BGY
178BGZ
178BHA
178BHB
178BHC
178BHD
178BHE
178BHF
178BHG
178BHH
178BHI
178BHJ
178BHK
178BHL
178BHM
178BHN
178BHO
178BHP
178BHQ
178BHR
178BHS
178BHT
178BHU
178BHV
178BHW
178BHX
178BHY
178BHZ
178BIA
178BIB
178BIC
178BID
178BIE
178BIF
178BIG
178BIH
178BII
178BIJ
178BIK
178BIL
178BIM
178BIN
178BIO
178BIP
178BIQ
178BIR
178BIS
178BIT
178BIU
178BIV
178BIW
178BIX
178BIY
178BIZ
178BJA
178BJB
178BJC
178BJD
178BJE
178BJF
178BJG
178BJH
178BJI
178BJJ
178BJK
178BJL
178BJM
178BJN
178BJO
178BJP
178BJQ
178BJR
178BJS
178BJT
178BJU
178BJV
178BJW
178BJX
178BJY
178BJZ
178BKA
178BKB
178BKC
178BKD
178BKE
178BKF
178BKG
178BKH
178BKI
178BKJ
178BKK
178BKL
178BKM
178BKN
178BKO
178BKP
178BKQ
178BKR
178BKS
178BKT
178BKU
178BKV
178BKW
178BKX
178BKY
178BKZ
178BLA
178BLB
178BLC
178BLD
178BLE
178BLF
178BLG
178BLH
178BLI
178BLJ
178BLK
178BLL
178BLM
178BLN
178BLO
178BLP
178BLQ
178BLR
178BLS
178BLT
178BLU
178BLV
178BLW
178BLX
178BLY
178BLZ
178BMA
178BMB
178BMC
178BMD
178BME
178BMF
178BMG
178BMH
178BMI
178BMJ
178BMK
178BML
178BMM
178BMN
178BMO
178BMP
178BMQ
178BMR
178BMS
178BMT
178BMU
178BMV
178BMW
178BMX
178BMY
178BMZ
178BNA
178BNB
178BNC
178BND
178BNE
178BNF
178BNG
178BNH
178BNI
178BNJ
178BNK
178BNL
178BNM
178BNN
178BNO
178BNP
178BNQ
178BNR
178BNS
178BNT
178BNU
178BNV
178BNW
178BNX
178BNY
178BNZ
178BOA
178BOB
178BOC
178BOD
178BOE
178BOF
178BOG
178BOH
178BOI
178BOJ
178BOK
178BOL
178BOM
178BON
178BOO
178BOP
178BOQ
178BOR
178BOS
178BOT
178BOU
178BOV
178BOW
178BOX
178BOY
178BOZ
178BPA
178BPB
178BPC
178BPD
178BPE
178BPF
178BPG
178BPH
178BPI
178BPJ
178BPK
178BPL
178BPM
178BPN
178BPO
178BPP
178BPQ
178BPR
178BPS
178BPT
178BPU
178BPV
178BPW
178BPX
178BPY
178BPZ
178BQA
178BQB
178BQC
178BQD
178BQE
178BQF
178BQG
178BQH
178BQI
178BQJ
178BQK
178BQL
178BQM
178BQN
178BQO
178BQP
178BQQ
178BQR
178BQS
178BQT
178BQU
178BQV
178BQW
178BQX
178BQY
178BQZ
178BRA
178BRB
178BRC
178BRD
178BRE
178BRF
178BRG
178BRH
178BRI
178BRJ
178BRK
178BRL
178BRM
178BRN
178BRO
178BRP
178BRQ
178BRR
178BRS
178BRT
178BRU
178BRV
178BRW
178BRX
178BRY
178BRZ
178BSA
178BSB
178BSC
178BSD
178BSE
178BSF
178BSG
178BSH
178BSI
178BSJ
178BSK
178BSL
178BSM
178BSN
178BSO
178BSP
178BSQ
178BSR
178BSS
178BST
178BSU
178BSV
178BSW
178BSX
178BSY
178BSZ
178BTA
178BTB
178BTC
178BTD
178BTE
178BTF
178BTG
178BTH
178BTI
178BTJ
178BTK
178BTL
178BTM
178BTN
178BTO
178BTP
178BTQ
178BTR
178BTS
178BTT
178BTU
178BTV
178BTW
178BTX
178BTY
178BTZ
178BUA
178BUB
178BUC
178BUD
178BUE
178BUF
178BUG
178BUH
178BUI
178BUJ
178BUK
178BUL
178BUM
178BUN
178BUO
178BUP
178BUQ
178BUR
178BUS
178BUT
178BUU
178BUV
178BUW
178BUX
178BUY
178BUZ
178BVA
178BVB
178BVC
178BVD
178BVE
178BVF
178BVG
178BVH
178BVI
178BVJ
178BVK
178BVL
178BVM
178BVN
178BVO
178BVP
178BVQ
178BVR
178BVS
178BVT
178BVU
178BVV
178BVW
178BVX
178BVY
178BVZ
178BWA
178BWB
178BWC
178BWD
178BWE
178BWF
178BWG
178BWH
178BWI
178BWJ
178BWK
178BWL
178BWM
178BWN
178BWO
178BWP
178BWQ
178BWR
178BWS
178BWT
178BWU
178BWV
178BWW
178BWX
178BWY
178BWZ
178BXA
178BXB
178BXC
178BXD
178BXE
178BXF
178BXG
178BXH
178BXI
178BXJ
178BXK
178BXL
178BXM
178BXN
178BXO
178BXP
178BXQ
178BXR
178BXS
178BXT
178BXU
178BXV
178BXW
178BXX
178BXY
178BXZ
178BYA
178BYB
178BYC
178BYD
178BYE
178BYF
178BYG
178BYH
178BYI
178BYJ
178BYK
178BYL
178BYM
178BYN
178BYO
178BYP
178BYQ
178BYR
178BYS
178BYT
178BYU
178BYV
178BYW
178BYX
178BYY
178BYZ
178BZA
178BZB
178BZC
178BZD
178BZE
178BZF
178BZG
178BZH
178BZI
178BZJ
178BZK
178BZL
178BZM
178BZN
178BZO
178BZP
178BZQ
178BZR
178BZS
178BZT
178BZU
178BZV
178BZW
178BZX
178BZY
178BZZ
178CAA
178CAB
178CAC
178CAD
178CAE
178CAF
178CAG
178CAH
178CAI
178CAJ
178CAK
178CAL
178CAM
178CAN
178CAO
178CAP
178CAQ
178CAR
178CAS
178CAT
178CAU
178CAV
178CAW
178CAX
178CAY
178CAZ
178CBA
178CBB
178CBC
178CBD
178CBE
178CBF
178CBG
178CBH
178CBI
178CBJ
178CBK
178CBL
178CBM
178CBN
178CBO
178CBP
178CBQ
178CBR
178CBS
178CBT
178CBU
178CBV
178CBW
178CBX
178CBY
178CBZ
178CCA
178CCB
178CCC
178CCD
178CCE
178CCF
178CCG
178CCH
178CCI
178CCJ
178CCK
178CCL
178CCM
178CCN
178CCO
178CCP
178CCQ
178CCR
178CCS
178CCT
178CCU
178CCV
178CCW
178CCX
178CCY
178CCZ
178CDA
178CDB
178CDC
178CDD
178CDE
178CDF
178CDG
178CDH
178CDI
178CDJ
178CDK
178CDL
178CDM
178CDN
178CDO
178CDP
178CDQ
178CDR
178CDS
178CDT
178CDU
178CDV
178CDW
178CDX
178CDY
178CDZ
178CEA
178CEB
178CEC
178CED
178CEE
178CEF
178CEG
178CEH
178CEI
178CEJ
178CEK
178CEL
178CEM
178CEN
178CEO
178CEP
178CEQ
178CER
178CES
178CET
178CEU
178CEV
178CEW
178CEX
178CEY
178CEZ
178CFA
178CFB
178CFC
178CFD
178CFE
178CFF
178CFG
178CFH
178CFI
178CFJ
178CFK
178CFL
178CFM
178CFN
178CFO
178CFP
178CFQ
178CFR
178CFS
178CFT
178CFU
178CFV
178CFW
178CFX
178CFY
178CFZ
178CGA
178CGB
178CGC
178CGD
178CGE
178CGF
178CGG
178CGH
178CGI
178CGJ
178CGK
178CGL
178CGM
178CGN
178CGO
178CGP
178CGQ
178CGR
178CGS
178CGT
178CGU
178CGV
178CGW
178CGX
178CGY
178CGZ
178CHA
178CHB
178CHC
178CHD
178CHE
178CHF
178CHG
178CHH
178CHI
178CHJ
178CHK
178CHL
178CHM
178CHN
178CHO
178CHP
178CHQ
178CHR
178CHS
178CHT
178CHU
178CHV
178CHW
178CHX
178CHY
178CHZ
178CIA
178CIB
178CIC
178CID
178CIE
178CIF
178CIG
178CIH
178CII
178CIJ
178CIK
178CIL
178CIM
178CIN
178CIO
178CIP
178CIQ
178CIR
178CIS
178CIT
178CIU
178CIV
178CIW
178CIX
178CIY
178CIZ
178CJA
178CJB
178CJC
178CJD
178CJE
178CJF
178CJG
178CJH
178CJI
178CJJ
178CJK
178CJL
178CJM
178CJN
178CJO
178CJP
178CJQ
178CJR
178CJS
178CJT
178CJU
178CJV
178CJW
178CJX
178CJY
178CJZ
178CKA
178CKB
178CKC
178CKD
178CKE
178CKF
178CKG
178CKH
178CKI
178CKJ
178CKK
178CKL
178CKM
178CKN
178CKO
178CKP
178CKQ
178CKR
178CKS
178CKT
178CKU
178CKV
178CKW
178CKX
178CKY
178CKZ
178CLA
178CLB
178CLC
178CLD
178CLE
178CLF
178CLG
178CLH
178CLI
178CLJ
178CLK
178CLL
178CLM
178CLN
178CLO
178CLP
178CLQ
178CLR
178CLS
178CLT
178CLU
178CLV
178CLW
178CLX
178CLY
178CLZ
178CMA
178CMB
178CMC
178CMD
178CME
178CMF
178CMG
178CMH
178CMI
178CMJ
178CMK
178CML
178CMM
178CMN
178CMO
178CMP
178CMQ
178CMR
178CMS
178CMT
178CMU
178CMV
178CMW
178CMX
178CMY
178CMZ
178CNA
178CNB
178CNC
178CND
178CNE
178CNF
178CNG
178CNH
178CNI
178CNJ
178CNK
178CNL
178CNM
178CNN
178CNO
178CNP
178CNQ
178CNR
178CNS
178CNT
178CNU
178CNV
178CNW
178CNX
178CNY
178CNZ
178COA
178COB
178COC
178COD
178COE
178COF
178COG
178COH
178COI
178COJ
178COK
178COL
178COM
178CON
178COO
178COP
178COQ
178COR
178COS
178COT
178COU
178COV
178COW
178COX
178COY
178COZ
178CPA
178CPB
178CPC
178CPD
178CPE
178CPF
178CPG
178CPH
178CPI
178CPJ
178CPK
178CPL
178CPM
178CPN
178CPO
178CPP
178CPQ
178CPR
178CPS
178CPT
178CPU
178CPV
178CPW
178CPX
178CPY
178CPZ
178CQA
178CQB
178CQC
178CQD
178CQE
178CQF
178CQG
178CQH
178CQI
178CQJ
178CQK
178CQL
178CQM
178CQN
178CQO
178CQP
178CQQ
178CQR
178CQS
178CQT
178CQU
178CQV
178CQW
178CQX
178CQY
178CQZ
178CRA
178CRB
178CRC
178CRD
178CRE
178CRF
178CRG
178CRH
178CRI
178CRJ
178CRK
178CRL
178CRM
178CRN
178CRO
178CRP
178CRQ
178CRR
178CRS
178CRT
178CRU
178CRV
178CRW
178CRX
178CRY
178CRZ
178CSA
178CSB
178CSC
178CSD
178CSE
178CSF
178CSG
178CSH
178CSI
178CSJ
178CSK
178CSL
178CSM
178CSN
178CSO
178CSP
178CSQ
178CSR
178CSS
178CST
178CSU
178CSV
178CSW
178CSX
178CSY
178CSZ
178CTA
178CTB
178CTC
178CTD
178CTE
178CTF
178CTG
178CTH
178CTI
178CTJ
178CTK
178CTL
178CTM
178CTN
178CTO
178CTP
178CTQ
178CTR
178CTS
178CTT
178CTU
178CTV
178CTW
178CTX
178CTY
178CTZ
178CUA
178CUB
178CUC
178CUD
178CUE
178CUF
178CUG
178CUH
178CUI
178CUJ
178CUK
178CUL
178CUM
178CUN
178CUO
178CUP
178CUQ
178CUR
178CUS
178CUT
178CUU
178CUV
178CUW
178CUX
178CUY
178CUZ
178CVA
178CVB
178CVC
178CVD
178CVE
178CVF
178CVG
178CVH
178CVI
178CVJ
178CVK
178CVL
178CVM
178CVN
178CVO
178CVP
178CVQ
178CVR
178CVS
178CVT
178CVU
178CVV
178CVW
178CVX
178CVY
178CVZ
178CWA
178CWB
178CWC
178CWD
178CWE
178CWF
178CWG
178CWH
178CWI
178CWJ
178CWK
178CWL
178CWM
178CWN
178CWO
178CWP
178CWQ
178CWR
178CWS
178CWT
178CWU
178CWV
178CWW
178CWX
178CWY
178CWZ
178CXA
178CXB
178CXC
178CXD
178CXE
178CXF
178CXG
178CXH
178CXI
178CXJ
178CXK
178CXL
178CXM
178CXN
178CXO
178CXP
178CXQ
178CXR
178CXS
178CXT
178CXU
178CXV
178CXW
178CXX
178CXY
178CXZ
178CYA
178CYB
178CYC
178CYD
178CYE
178CYF
178CYG
178CYH
178CYI
178CYJ
178CYK
178CYL
178CYM
178CYN
178CYO
178CYP
178CYQ
178CYR
178CYS
178CYT
178CYU
178CYV
178CYW
178CYX
178CYY
178CYZ
178CZA
178CZB
178CZC
178CZD
178CZE
178CZF
178CZG
178CZH
178CZI
178CZJ
178CZK
178CZL
178CZM
178CZN
178CZO
178CZP
178CZQ
178CZR
178CZS
178CZT
178CZU
178CZV
178CZW
178CZX
178CZY
178CZZ
178DAA
178DAB
178DAC
178DAD
178DAE
178DAF
178DAG
178DAH
178DAI
178DAJ
178DAK
178DAL
178DAM
178DAN
178DAO
178DAP
178DAQ
178DAR
178DAS
178DAT
178DAU
178DAV
178DAW
178DAX
178DAY
178DAZ
178DBA
178DBB
178DBC
178DBD
178DBE
178DBF
178DBG
178DBH
178DBI
178DBJ
178DBK
178DBL
178DBM
178DBN
178DBO
178DBP
178DBQ
178DBR
178DBS
178DBT
178DBU
178DBV
178DBW
178DBX
178DBY
178DBZ
178DCA
178DCB
178DCC
178DCD
178DCE
178DCF
178DCG
178DCH
178DCI
178DCJ
178DCK
178DCL
178DCM
178DCN
178DCO
178DCP
178DCQ
178DCR
178DCS
178DCT
178DCU
178DCV
178DCW
178DCX
178DCY
178DCZ
178DDA
178DDB
178DDC
178DDD
178DDE
178DDF
178DDG
178DDH
178DDI
178DDJ
178DDK
178DDL
178DDM
178DDN
178DDO
178DDP
178DDQ
178DDR
178DDS
178DDT
178DDU
178DDV
178DDW
178DDX
178DDY
178DDZ
178DEA
178DEB
178DEC
178DED
178DEE
178DEF
178DEG
178DEH
178DEI
178DEJ
178DEK
178DEL
178DEM
178DEN
178DEO
178DEP
178DEQ
178DER
178DES
178DET
178DEU
178DEV
178DEW
178DEX
178DEY
178DEZ
178DFA
178DFB
178DFC
178DFD
178DFE
178DFF
178DFG
178DFH
178DFI
178DFJ
178DFK
178DFL
178DFM
178DFN
178DFO
178DFP
178DFQ
178DFR
178DFS
178DFT
178DFU
178DFV
178DFW
178DFX
178DFY
178DFZ
178DGA
178DGB
178DGC
178DGD
178DGE
178DGF
178DGG
178DGH
178DGI
178DGJ
178DGK
178DGL
178DGM
178DGN
178DGO
178DGP
178DGQ
178DGR
178DGS
178DGT
178DGU
178DGV
178DGW
178DGX
178DGY
178DGZ
178DHA
178DHB
178DHC
178DHD
178DHE
178DHF
178DHG
178DHH
178DHI
178DHJ
178DHK
178DHL
178DHM
178DHN
178DHO
178DHP
178DHQ
178DHR
178DHS
178DHT
178DHU
178DHV
178DHW
178DHX
178DHY
178DHZ
178DIA
178DIB
178DIC
178DID
178DIE
178DIF
178DIG
178DIH
178DII
178DIJ
178DIK
178DIL
178DIM
178DIN
178DIO
178DIP
178DIQ
178DIR
178DIS
178DIT
178DIU
178DIV
178DIW
178DIX
178DIY
178DIZ
178DJA
178DJB
178DJC
178DJD
178DJE
178DJF
178DJG
178DJH
178DJI
178DJJ
178DJK
178DJL
178DJM
178DJN
178DJO
178DJP
178DJQ
178DJR
178DJS
178DJT
178DJU
178DJV
178DJW
178DJX
178DJY
178DJZ
178DKA
178DKB
178DKC
178DKD
178DKE
178DKF
178DKG
178DKH
178DKI
178DKJ
178DKK
178DKL
178DKM
178DKN
178DKO
178DKP
178DKQ
178DKR
178DKS
178DKT
178DKU
178DKV
178DKW
178DKX
178DKY
178DKZ
178DLA
178DLB
178DLC
178DLD
178DLE
178DLF
178DLG
178DLH
178DLI
178DLJ
178DLK
178DLL
178DLM
178DLN
178DLO
178DLP
178DLQ
178DLR
178DLS
178DLT
178DLU
178DLV
178DLW
178DLX
178DLY
178DLZ
178DMA
178DMB
178DMC
178DMD
178DME
178DMF
178DMG
178DMH
178DMI
178DMJ
178DMK
178DML
178DMM
178DMN
178DMO
178DMP
178DMQ
178DMR
178DMS
178DMT
178DMU
178DMV
178DMW
178DMX
178DMY
178DMZ
178DNA
178DNB
178DNC
178DND
178DNE
178DNF
178DNG
178DNH
178DNI
178DNJ
178DNK
178DNL
178DNM
178DNN
178DNO
178DNP
178DNQ
178DNR
178DNS
178DNT
178DNU
178DNV
178DNW
178DNX
178DNY
178DNZ
178DOA
178DOB
178DOC
178DOD
178DOE
178DOF
178DOG
178DOH
178DOI
178DOJ
178DOK
178DOL
178DOM
178DON
178DOO
178DOP
178DOQ
178DOR
178DOS
178DOT
178DOU
178DOV
178DOW
178DOX
178DOY
178DOZ
178DPA
178DPB
178DPC
178DPD
178DPE
178DPF
178DPG
178DPH
178DPI
178DPJ
178DPK
178DPL
178DPM
178DPN
178DPO
178DPP
178DPQ
178DPR
178DPS
178DPT
178DPU
178DPV
178DPW
178DPX
178DPY
178DPZ
178DQA
178DQB
178DQC
178DQD
178DQE
178DQF
178DQG
178DQH
178DQI
178DQJ
178DQK
178DQL
178DQM
178DQN
178DQO
178DQP
178DQQ
178DQR
178DQS
178DQT
178DQU
178DQV
178DQW
178DQX
178DQY
178DQZ
178DRA
178DRB
178DRC
178DRD
178DRE
178DRF
178DRG
178DRH
178DRI
178DRJ
178DRK
178DRL
178DRM
178DRN
178DRO
178DRP
178DRQ
178DRR
178DRS
178DRT
178DRU
178DRV
178DRW
178DRX
178DRY
178DRZ
178DSA
178DSB
178DSC
178DSD
178DSE
178DSF
178DSG
178DSH
178DSI
178DSJ
178DSK
178DSL
178DSM
178DSN
178DSO
178DSP
178DSQ
178DSR
178DSS
178DST
178DSU
178DSV
178DSW
178DSX
178DSY
178DSZ
178DTA
178DTB
178DTC
178DTD
178DTE
178DTF
178DTG
178DTH
178DTI
178DTJ
178DTK
178DTL
178DTM
178DTN
178DTO
178DTP
178DTQ
178DTR
178DTS
178DTT
178DTU
178DTV
178DTW
178DTX
178DTY
178DTZ
178DUA
178DUB
178DUC
178DU

CATWALK AND CRANE SYSTEM

CROSS-REFERENCE TO RELATED APPLICATIONS

This application claims benefit of U.S. provisional patent application Ser. No. 62/330,721 filed May 2, 2016, and entitled "Catwalk and Crane System," which is hereby incorporated herein by reference in its entirety.

STATEMENT REGARDING FEDERALLY SPONSORED RESEARCH OR DEVELOPMENT

Not applicable.

BACKGROUND

Well systems configured for the production of oil and gas include running tubular members or drill pipes into and out of a borehole of the well system that extends into a subterranean earthen formation. In some applications, the individual drill pipe joints are transported from a storage area distal a drilling platform of the well system to a rig floor of the drilling platform utilizing a catwalk machine or other system configured to transport the pipe joint. Once on the rig floor, the pipe joint may be threadably connected to another drill pipe joint to form part of a drill string extending through the rig floor and into the borehole via a wellhead disposed at the surface. In certain applications, equipment not easily transportable via the catwalk machine may need to be transported to and from the rig floor. This equipment can be located in various places around the drilling rig. In some applications, a crane, such as a mobile crane or a drill floor mounted crane, is used to lift and move the equipment to the drill floor and back again.

SUMMARY

An embodiment of a catwalk and crane system for transporting equipment of a well system comprises a substructure, a directing frame pivotally coupled to the substructure, a pipe transporter configured to transport a tubular along the directing frame, a first actuator coupled to the directing frame and configured to rotate the directing frame relative to the substructure, and a crane coupled to the directing frame, wherein the crane is extendable from a first end of the directing frame. In some embodiments, the directing frame is rotatable, the crane is extendable, and the pipe transporter is moveable up the directing frame to deliver a tubular to and from a rig floor of the well system. In some embodiments, the catwalk and crane system further comprises a winch coupled to a cable that is suspended from the crane, wherein the winch is configured to extend and retract the cable, and the cable is configured to physically support a suspended load. In certain embodiments, when the load is coupled with the cable, the directing frame is configured to transport the load both vertically and horizontally in response to the extension of the crane from the first end of the directing frame. In certain embodiments, the catwalk and crane system further comprises a second actuator coupled to the directing frame and the crane, the second actuator configured to telescopically extend and retract the crane from the first end of the directing frame. In some embodiments, the load is coupled with the cable, the directing frame is configured to transport the load both vertically and horizontally in response to rotation of the directing frame relative to the substructure. In some embodiments, the pipe transporter comprises a catwalk skate configured to receive the tubular. In certain embodiments, the catwalk skate comprises rollers and is displaceable between the substructure and the directing frame to transport the tubular.

An embodiment of a catwalk and crane system for transporting equipment of a well system comprises a substructure, a directing frame pivotally coupled to the substructure, a pipe transporter configured to transport a tubular along the directing frame, a first actuator coupled to the directing frame and configured to rotate the directing frame relative to the substructure, a crane coupled to the directing frame, and a winch coupled to a cable that is suspended from the crane. In some embodiments, the winch is configured to extend and retract the cable, and the cable is configured to physically support a suspended load. In some embodiments, in response to actuation from the winch, the cable is configured to transport the load from a first position to a second position elevated from the first position. In certain embodiments, the catwalk and crane system further comprises a sheave coupled to a first end of the crane, wherein the sheave is configured to support the cable. In certain embodiments, the winch is coupled to the directing frame and rotatable with the directing frame relative to the substructure. In some embodiments, the first actuator is coupled between the directing frame and the substructure. In some embodiments, the catwalk and crane system further comprises a pipe support frame pivotally coupled to the substructure and to the directing frame, wherein the actuator is coupled between the pipe support frame and the directing frame.

An embodiment of a catwalk and crane system for transporting equipment of a well system comprises a substructure, a pipe support frame pivotally coupled to the substructure, a directing frame pivotally coupled to the pipe support frame, a pipe transporter configured to transport a tubular member along the directing frame, and a crane coupled to the directing frame, wherein the crane is extendable from a first end of the directing frame. In some embodiments, the catwalk and crane system further comprises a winch coupled to a cable that is suspended from the crane, wherein the winch is configured to extend and retract the cable, and the cable is configured to physically support a suspended load. In some embodiments, the pipe support frame comprises a first support surface, the directing frame comprises a second support surface, the pipe transporter comprises a ram configured to push the tubular along the first support surface and the second support surface. In certain embodiments, the catwalk and crane system further comprises a strut coupled between the directing frame and the substructure, wherein the strut is pivotally coupled to the directing frame a pivot joint, and a first actuator coupled between the directing frame and the pipe support frame and configured to rotate the directing frame about the pivot joint relative to the strut. In some embodiments, the first actuator is configured to actuate the catwalk and crane system between a loading position configured to receive the tubular, and a transport position configured to transport the tubular between the first support surface and the second support surface.

BRIEF DESCRIPTION OF THE DRAWINGS

For a detailed description of exemplary embodiments, reference will now be made to the accompanying drawings in which:

FIG. 10 is a perspective view of another embodiment of a catwalk and crane system for drilling and/or production of hydrocarbons in accordance with principles disclosed herein;

DETAILED DESCRIPTION

Figure 1:
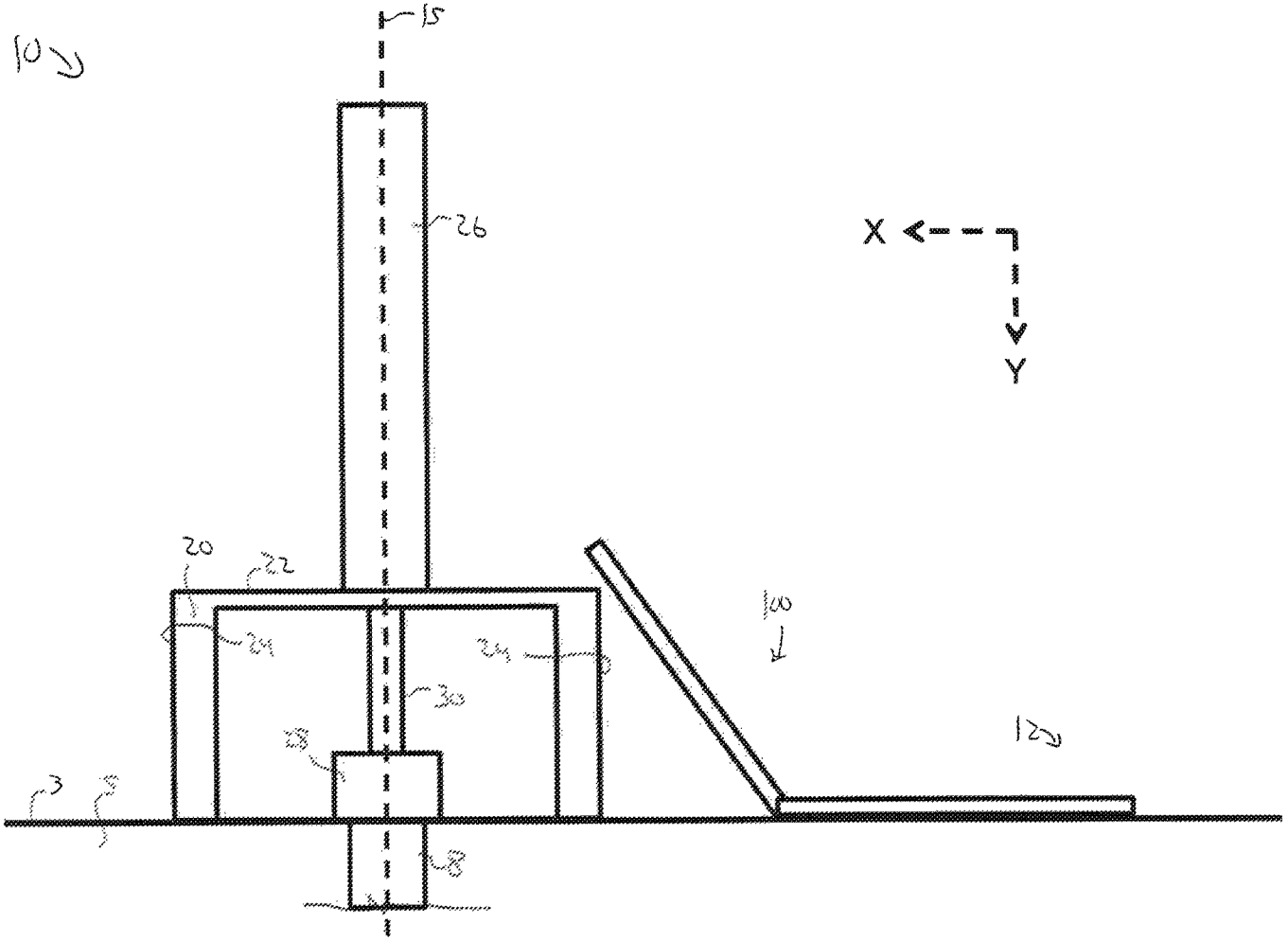
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. Well system 10 may be configured to extract various minerals and natural resources, including hydrocarbons (e.g., oil and/or natural gas), or to inject substances into an earthen formation 5 extending beneath the surface or ground 3 via a well or wellbore 8. In this arrangement, central axis 15 of system 10 extends substantially vertically (e.g., extending substantially parallel to the Y-axis shown in FIG. 1) relative to the substantially horizontally or laterally extending (e.g., extending substantially parallel to the X-axis shown in FIG. 1) surface 3. In the embodiment shown in FIG. 1, well system 10 generally includes a drilling rig or platform 20, a wellhead 28, and a catwalk machine or transportation assembly 100. Rig 20 includes a rig floor 22 extending between a pair of lateral sides or ends 24, where rig floor 22 is elevated or vertically spaced from the surface 3. Additionally, in the embodiment shown in FIG. 1, rig 20 also includes a derrick or mast 26 extending vertically along central axis 15 from rig floor 22, where mast 26 is configured to assist in the insertion and removal of tubular members, such as drill pipes, from wellbore 8.

Wellhead 28 of well system 10 extends vertically from surface 3 and is disposed coaxial with central axis 15 of well system 10. Wellhead 28 is generally configured to control fluid communication between wellhead 8 and the surrounding environment and to allow for the insertion and removal of a drill string 30 of well system 10 from wellbore 8, where drill string 30 comprises a series of tubular members or drill pipes threadably connected end-to-end. For example, when running drill string 30 into wellbore 8, an individual drill pipe joint may be transported to rig floor 22 and coupled with an upper end of drill string 30 extending vertically through a hole in the rig floor 22 that is aligned with central axis 15. In the embodiment shown in FIG. 1, tubular members, such as drill pipe joints of drill string 30, or other equipment may be located in a storage area 12 that is both vertically and horizontally spaced from the rig floor 22 of rig 20. In the embodiment shown in FIG. 1, transport assembly 100 of well system 10 is configured to transport tubular members, including drill pipe joints of drill string 30, between storage area 12 and rig floor 22. Additionally, as will be described further herein, transport assembly 100 is also configured to transport equipment other than tubular members between rig floor 22 and locations vertically and horizontally spaced from rig floor 22.

Figure 2:
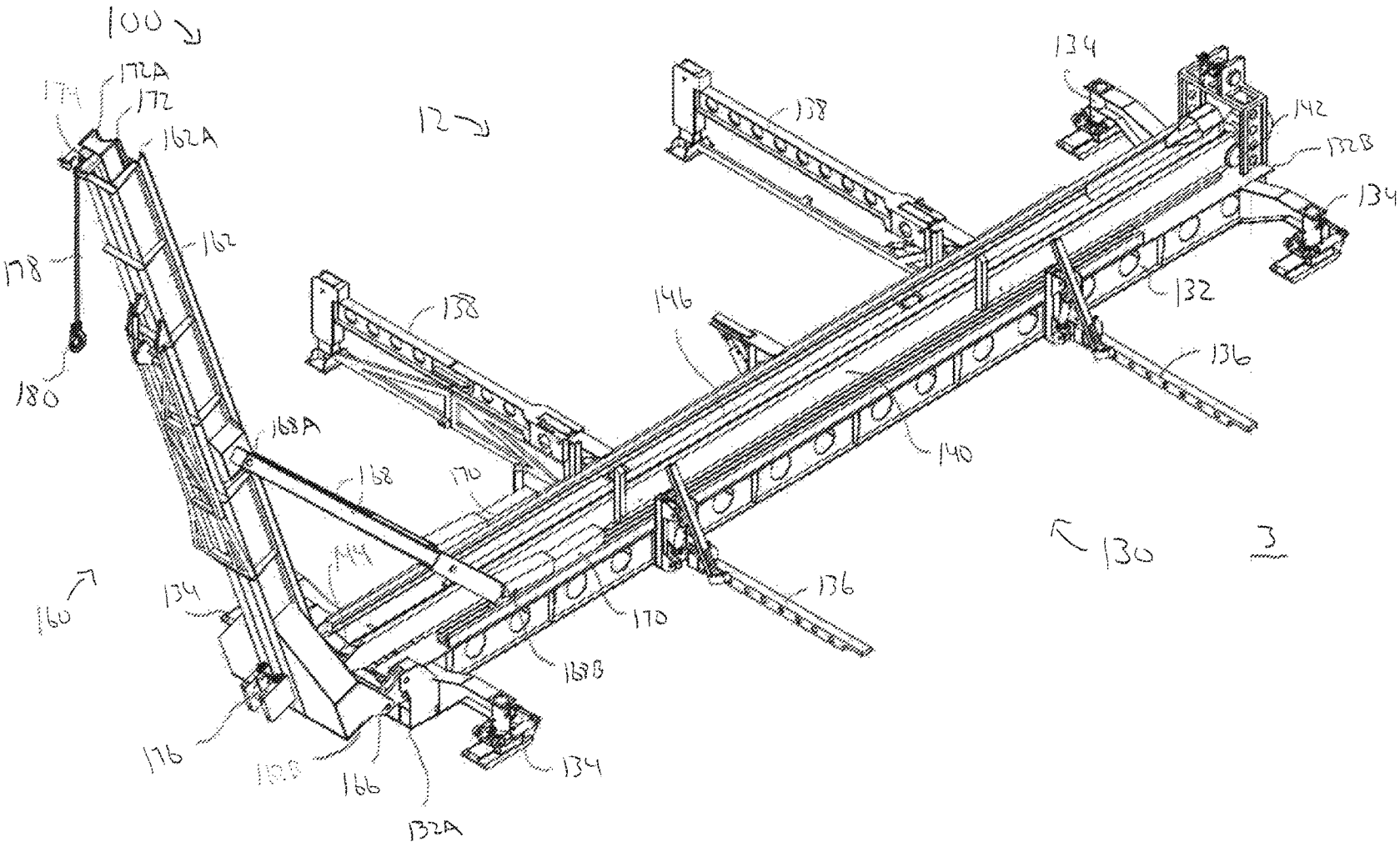
FIG. 2 is a perspective view of an embodiment of a catwalk and crane system for drilling and/or production of hydrocarbons in accordance with principles disclosed herein.
Figure 3:
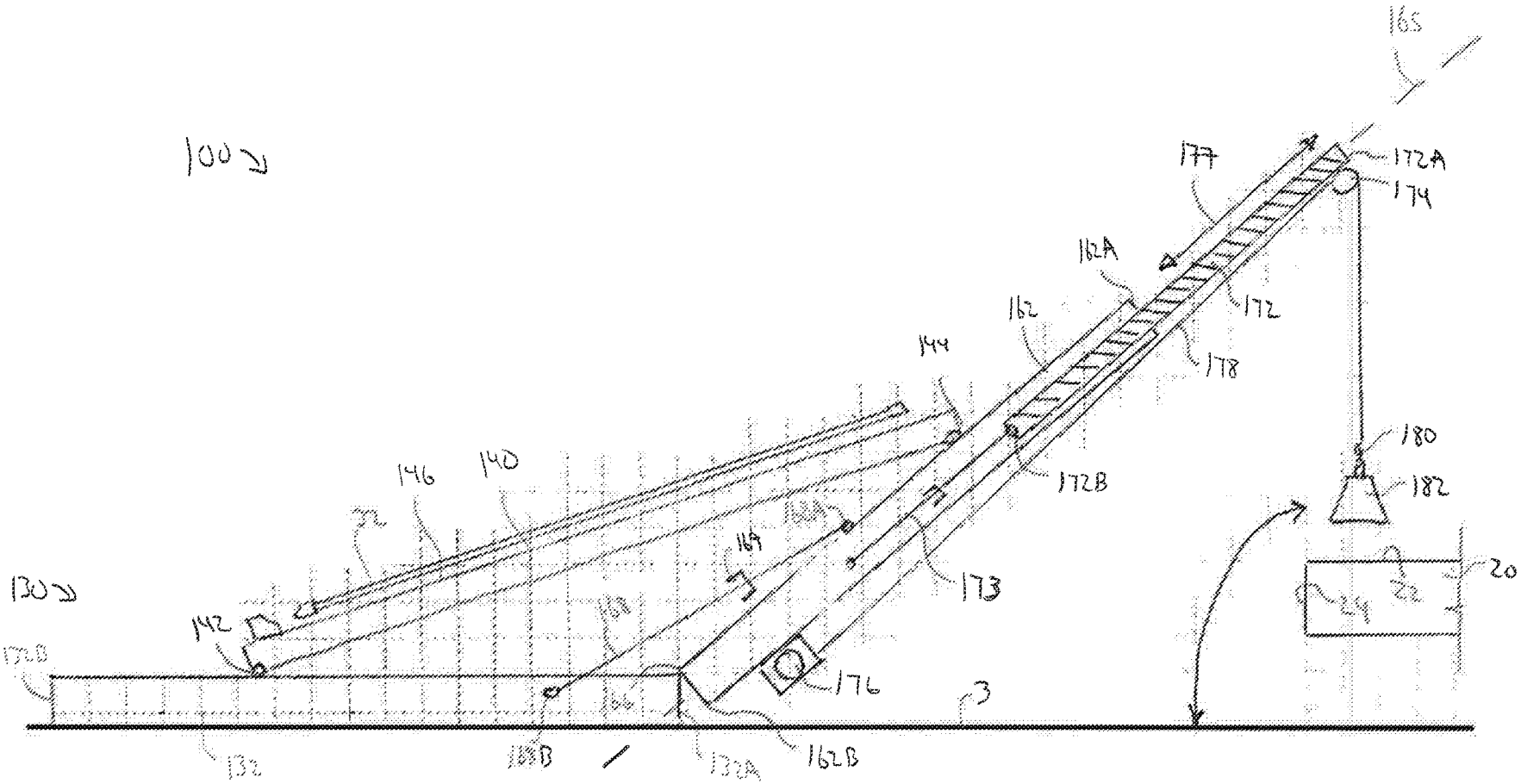
FIG. 3 is a side schematic view of the catwalk and crane system of FIG. 2.
Figure 4:
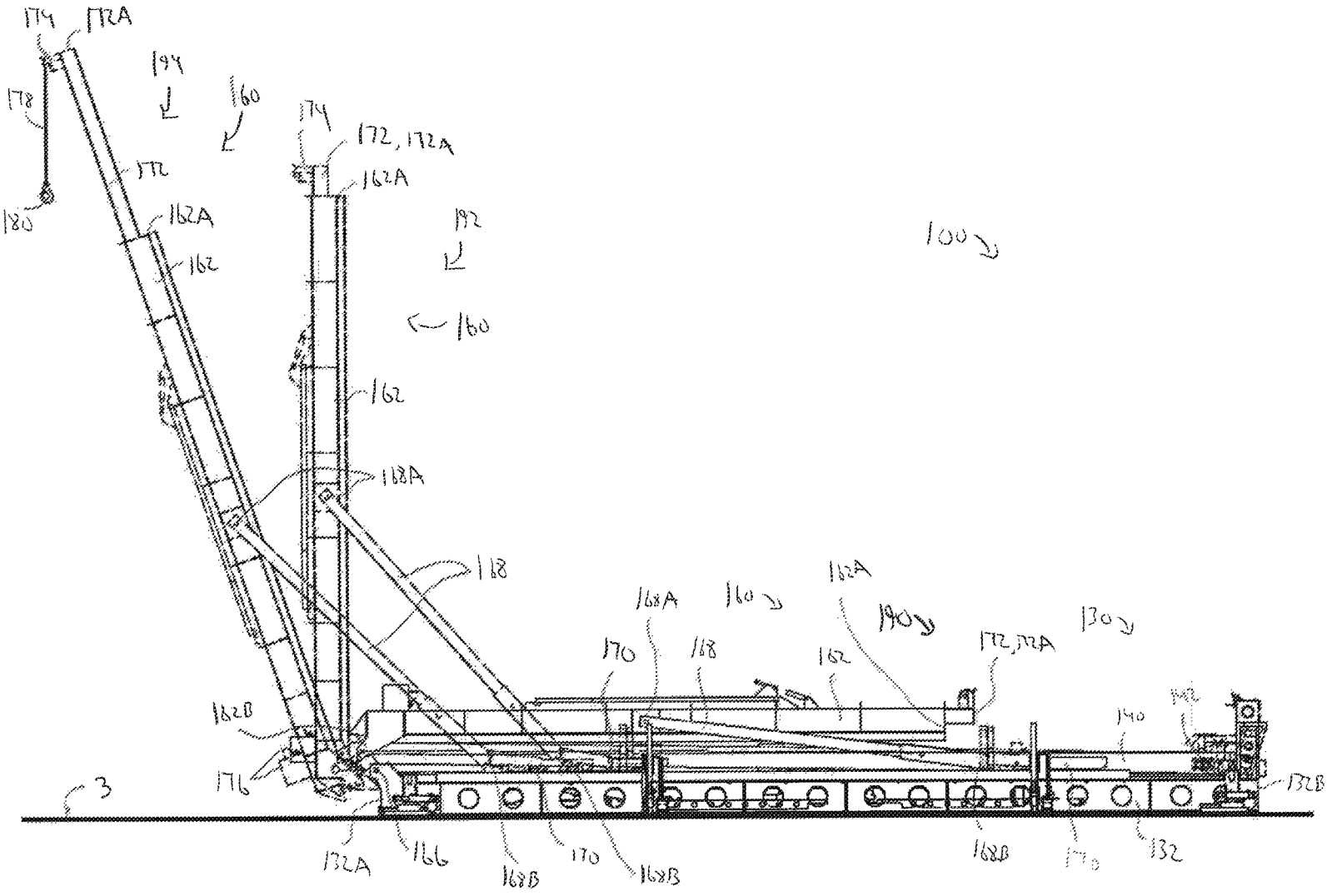
FIG. 4 is a side view of the catwalk and crane system of FIG. 2, with a crane unit in various retracted and extended positions.
Figure 9:
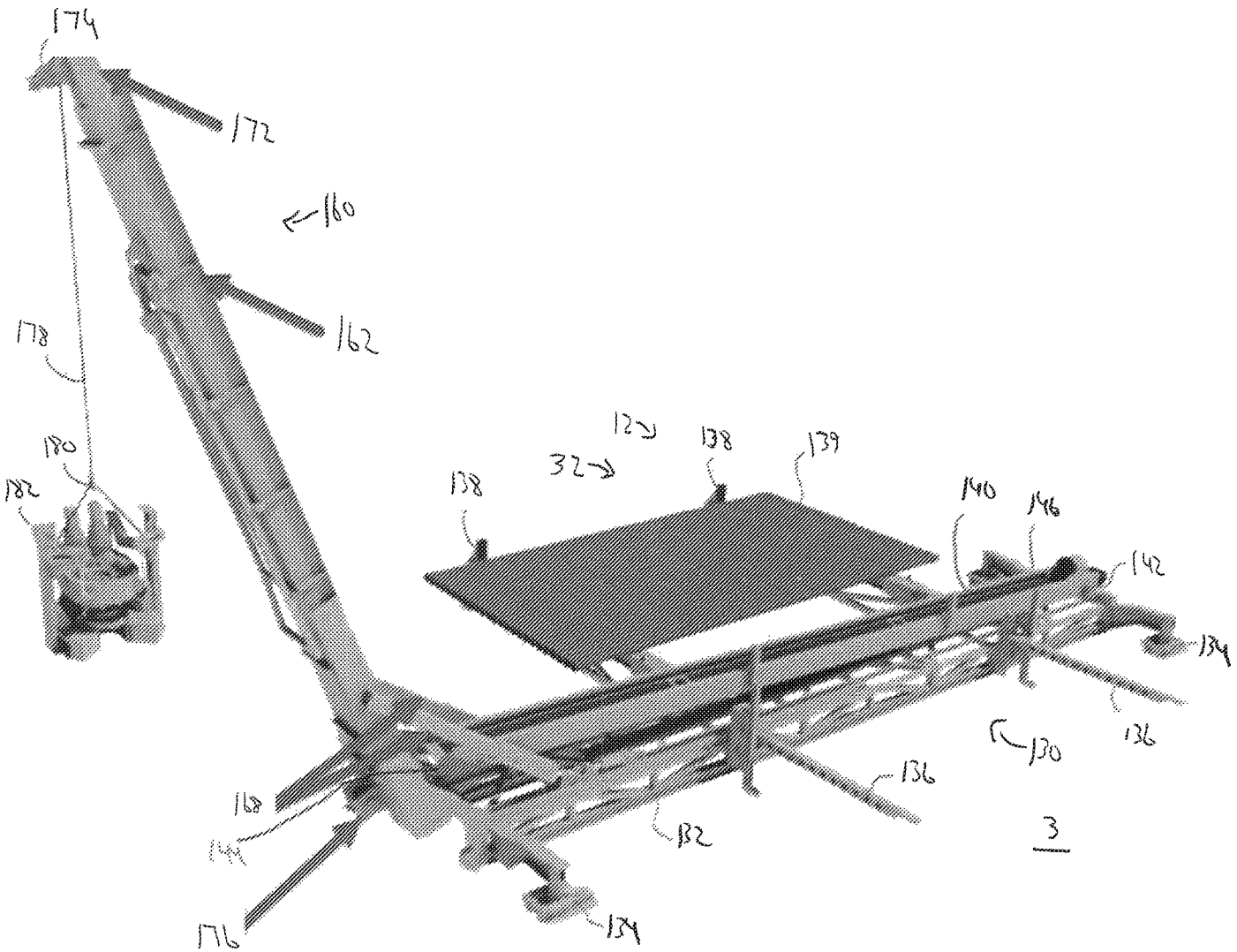
FIG. 9 is a perspective view of the catwalk and crane system of FIGS. 2-8 with pipe storage.

Referring to FIGS. 2 and 3, a tubular handling and transport system 100 (also referred to as a catwalk and crane system, or catwalk machine with crane) includes a catwalk unit 130 and crane unit 160. The catwalk unit 130 includes a substructure or support frame 132 with hydraulic moving feet 134, a first pair of moveable or retractable tubular support arms 136 extending from a first lateral side of support frame 132, and a second pair of moveable or retractable tubular support arms 138 extending from a second, opposing lateral side of support frame 132. Support frame 132 of catwalk unit 130 includes a first end 132A and a second end 132B longitudinally spaced from first end 132A. Feet 134 engage surface 3 to support catwalk unit 130 from each end 132A and 132B of support frame 132. Second support arms 138 of catwalk unit 130 may be positioned proximal the storage area 12 of well system 10. Referring briefly to FIG. 9, in some embodiments, catwalk unit 130 of crane system 100 may include a storage platform 139 supported by second side support arms 138, where storage platform 139 stores a plurality of tubular members or drill pipe joints 32 of well system 10. Referring again to FIGS.

2 and 3, the embodiment of catwalk unit 130 shown in FIGS. 2 and 3 also includes a pipe transporter or catwalk skate 140 having rollers 142 and 144 disposed at opposing longitudinal ends thereof and a tubular support surface 146 extending between the longitudinal ends of skate 140.

In the embodiment shown in FIGS. 2 and 3, crane unit 160 of crane system 100 includes a ramp or directing frame 162 and a telescopic member or crane 172 moveably or telescopically mounted within the directing frame 162. A pivotal coupling 166 connects the directing frame 162 to the catwalk unit 130. Particularly, directing frame 162 has a first longitudinal end 162A and a second longitudinal end 162B. The second end 162B of ramp 160 is pivotally coupled to the first end 132A of support frame 132 at a pivotal coupling or joint 166. Additionally, crane unit 160 includes a pair of adjustable struts 168, where a first longitudinal end of each strut 168 pivotally couples to a lateral side of directing frame 162 at a first pivotal coupling or joint 168A while a second longitudinal end of each strut 168 pivotally couples to an actuator or extension cylinder 170 at a second pivotal coupling or joint 168B.

First pivot joints 168A of struts 168 are longitudinally spaced from the ends 162A and 162B of directing frame 162 while extension cylinders 170 are coupled to support frame 132 of catwalk unit 130 proximal to, but longitudinally spaced from first end 132A of support frame 132. Each extension cylinder 170 is configured to extend and retract in a substantially horizontal direction (e.g., in a direction substantially parallel with the X-axis shown in FIG. 1) such that extension/retraction of extension cylinders 170 induces rotation of directing frame 162 about pivot joint 166 via the connection provided between extension cylinders 170 and directing frame 162 by struts 168. Additionally, an actuatable hydraulic cylinder or actuator 169 is mounted within each of the struts 168 to adjust the struts 168 and cause lulling of the directing frame 162. Particularly, each cylinder 169 is configured to extend or retract a corresponding strut 168, thereby rotating directing frame 162 about pivot joint 166.

During operation, skate 140 is configured to transport a tubular member, such as drill pipe joints 32, relative to support frame 132 of catwalk unit 130 and crane unit 160 when the tubular member is transported between storage area 12 and rig floor 22. In the embodiment shown in FIGS. 2 and 3, skate 140 is configured to receive or physically support a tubular member and may be moved or transported between support frame 132 and frame 162 via rollers 142 and 144, and a drive mechanism or actuator (not shown). In some embodiments, the drive mechanism comprises a chain or cable drive. In other embodiments, the drive mechanism may comprise various other drives known to be used for catwalk skates.

In the embodiment shown in FIGS. 2 and 3, crane 172 is received at least partially within directing frame 162 and configured to telescopically extend and retract from the first end 162A of directing frame 162. In this arrangement, crane unit 160 has a longitudinal distance or length extending between a first or outer end 172A of crane 172 and the second end 162B of directing frame 162, where the longitudinal distance between outer end 172A of crane 172 and the second end 162B of directing frame 162 may be adjusted or altered by extending or retracting crane 172. As shown particularly in FIG. 3, a hydraulic cylinder or actuator 173 is received in and coupled with directing frame 162. Hydraulic cylinder 173 is also coupled to a second or inner end 172B of crane 172 and is configured to displace crane 172 telescopically (indicated by arrow 177 in FIG. 3) along a central or longitudinal axis 165 of crane unit 160 relative to directing frame 162. In this arrangement, hydraulic cylinder 173 is configured to extend and retract crane 172 from first end 162A of directing frame 162.

In the embodiment shown in FIGS. 2 and 3, crane unit 160 also includes a winch 176 mounted proximal the second end 162B of directing frame 162 that controls a cable or line 178 extending from winch 176, through or around a sheave 174 mounted to the first end 162A of directing frame 162, and to a releasable connector or hook 180. In this arrangement, sheave 174 is configured to support cable 178 and facilitate the retraction and extension of cable 178 from winch 176. Cable 178 is configured to support the weight of equipment 182 suspended from hook 180 while winch 176 is configured to extend and retract cable 178, which thereby vertically lowers and raises hook 180 relative to the surface 3. In this manner, the vertical position of equipment 182 (e.g., position of equipment 182 along a vertical axis parallel to the Y-axis shown in FIG. 1) suspended from hook 180 may be adjusted in isolation. In other words, actuating winch 176 allows an operator of crane system 100 to adjust only the vertical position of equipment 182. In some applications, the ability to independently adjust the position of equipment 182 suspended from transport assembly 100 along only a single axis (e.g., a vertical axis relative surface 3) may simplify and/or provide greater flexibility in the operation of transporting equipment 182 via crane system 100.

Referring to FIGS. 4-8, the operation of crane system 100 will now be described in view of the embodiment of crane system 100 shown in FIGS. 4-8. Particularly, in operation, crane unit 160 of crane system 100 includes an initial or retracted position 190 shown in FIG. 4 where frame 162 is disposed substantially horizontally adjacent support frame 132. In the retracted position 190, extension cylinders 170 may be actuated to react against struts 168 and thereby rotate struts 168 about pivot joints 168B and in-turn rotate directing frame 162 about pivot joint 166 (via the connection formed between struts 168 and directing frame 162 at pivot joints 168A) until crane unit 160 is disposed in a second or intermediate position 192 (shown in dashed lines in FIG. 4). In the intermediate position 192, extension cylinders 170 may continue to actuate and thereby rotate struts 168 about pivot joints 168B and frame 162 about pivot joint 166 until crane unit 160 is disposed in an extended or operating position 194 (shown also in dashed lines in FIG. 4). In the operating position 194, as will be detailed more fully below, the cylinders 169 disposed in struts 168 may be actuated to luff, or lift and lower by rotation, the directing frame 162.

Figure 5:
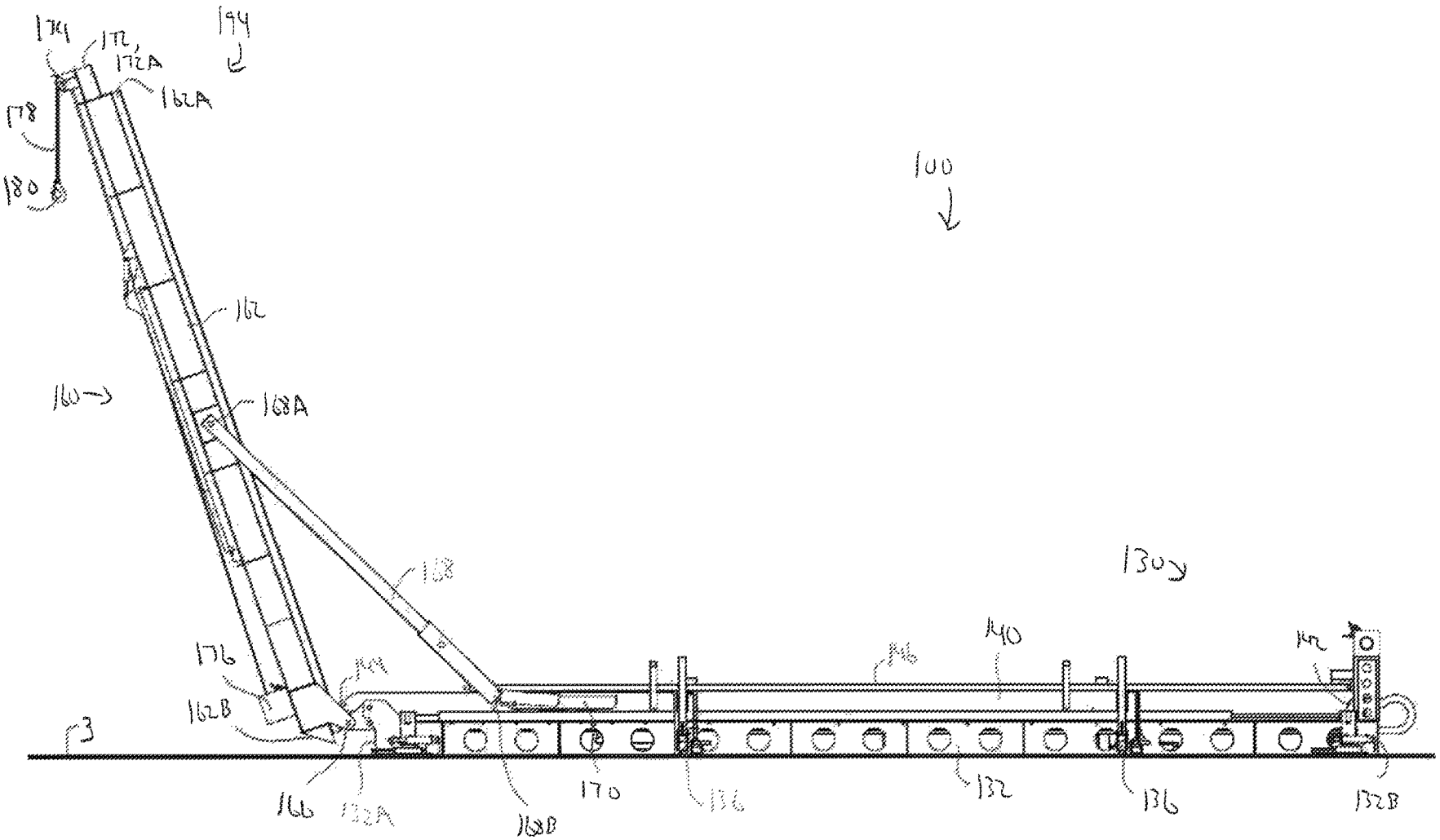
FIG. 5 is a side view of an extended operating position of the catwalk and crane system of FIGS. 2 and 4.
Figure 6:
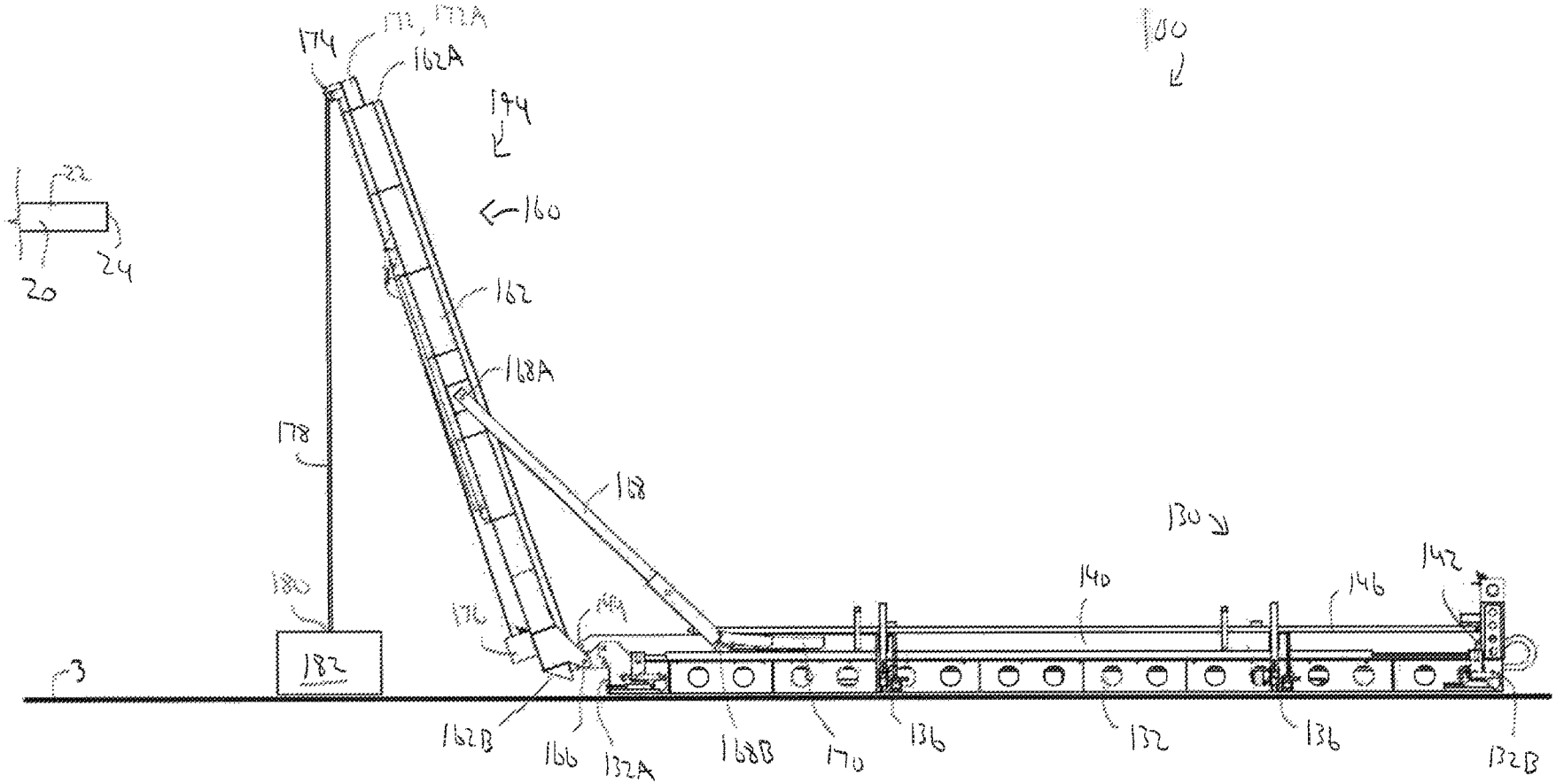
FIG. 6 is a side view of an extended winch and cable operating position of the catwalk and crane system of FIGS. 2 and 4.

FIG. 5 illustrates crane system 100 with crane unit 160 in the operating position 194. As shown in FIG. 5, prior to coupling hook 180 with equipment 182, crane unit 160 is disposed in the operating position 194 and cable 178 is retracted until hook 180 is disposed in a first or retracted position proximal sheave 174 and distal the surface 3. With hook 180 disposed in the retracted position shown in FIG. 5, equipment 182 to be transported from a position at or proximal surface 3 to the rig floor 22 of drilling rig 20 may be positioned proximal crane system 100, as shown in FIG. 6. Following the positioning of equipment 182 proximal to crane system 100, winch 176 may be actuated to lower the cable 178 and hook 180 to a second or extended position where hook 180 is disposed proximal the surface 3. In the position shown in FIG. 6, hook 180 may be releasably coupled with equipment 182 disposed at the surface 3.

Figure 7:
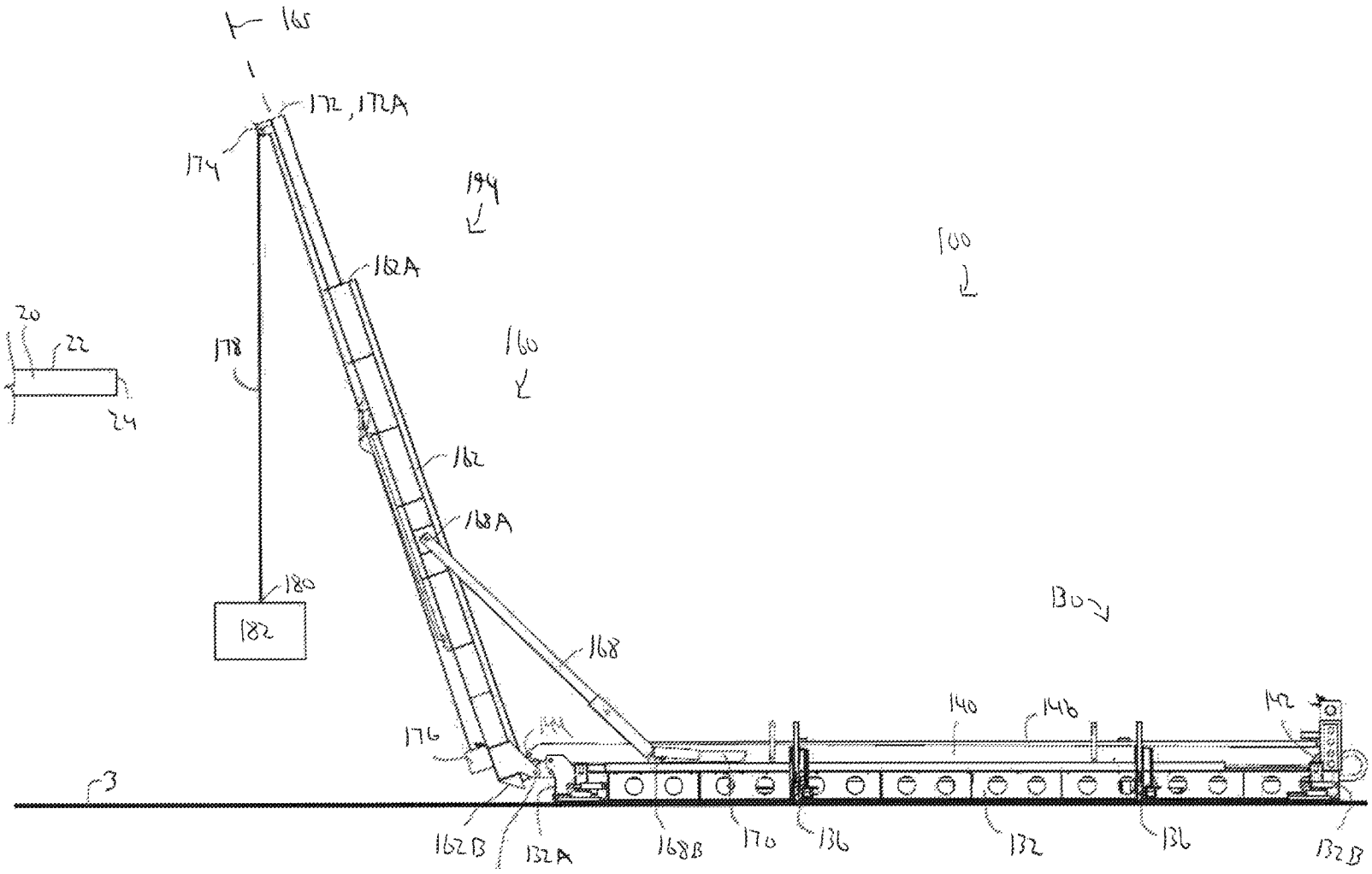
FIG. 7 is a side view of an extended crane position of the catwalk and crane system of FIGS. 2 and 4.

Following the coupling of equipment 182 with hook 180, equipment 182 may be lifted from the surface 3 via cable 178, as shown in FIG. 7. Particularly, in the embodiment shown in FIGS. 4-8, cylinder 173 is actuated to telescopically extend crane 172 along central axis 165 from the first end 162A of directing frame 162. Given that central axis 165 of crane unit 160 is disposed at an angle relative the vertical and horizontal axes (the Y-axis and X-axis shown in FIG. 1, respectively), extension of crane 172 along central axis 165 transports equipment 182 both vertically from surface 3 and horizontally towards rig floor 22.

In some embodiments, either prior to, during, or following the actuation of cylinder 173, winch 176 may be actuated to retract cable 178 and hook 180 to thereby vertically lift equipment 182. In embodiments where winch 176 and cylinder 173 are not operated simultaneously, winch 176 allows crane system 100 to transport equipment 182 in a single axial direction. Particularly, actuation of winch 176 is configured to transport equipment 182 in only a vertical direction (e.g., along an axis parallel with the Y-axis shown in FIG. 1). In some embodiments, winch 176 may be used to lift equipment 182 to a position above rig floor 22 prior to equipment 182 being transported horizontally (e.g., in a direction parallel with the X-axis shown in FIG. 1) towards rig floor 22 of drilling rig 20. In some applications, vertically lifting equipment 182 to a position vertically above rig floor 22 prior to transporting lifting equipment 182 in a horizontal direction may reduce the possibility of colliding equipment 182 with a lateral side 24 of rig 20 during a transport operation.

Figure 8:
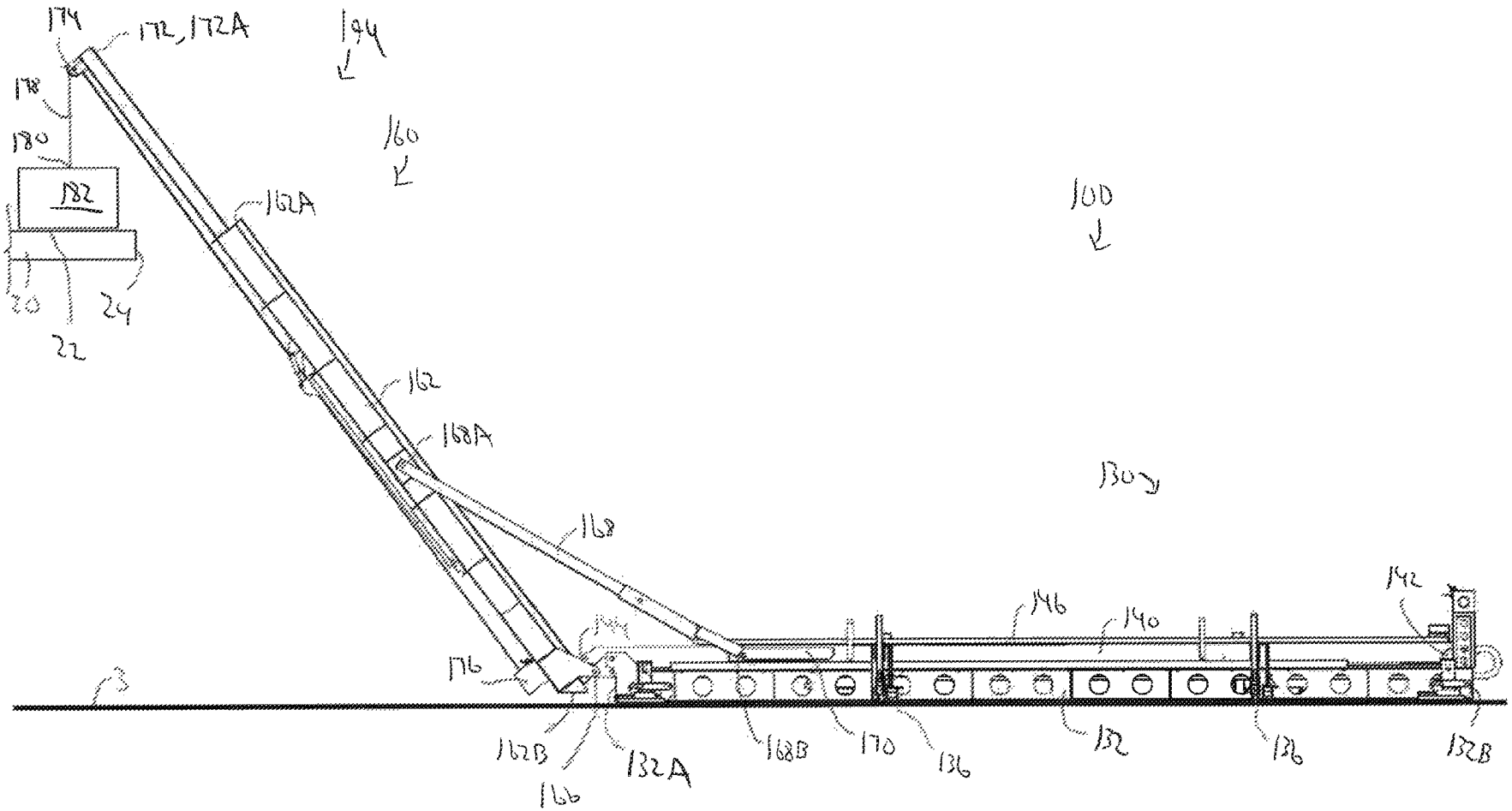
FIG. 8 is a side view of a directing frame and crane extended position of the catwalk and crane system of FIGS. 2 and 4.

In the embodiment shown in FIGS. 4-8, equipment 182 is lifted via winch 176 and/or cylinder 173 until it occupies an upper or elevated position vertically elevated from (but horizontally spaced from) rig floor 22. Once equipment 182 is disposed in the elevated position, equipment 182 may be transported in a horizontal direction towards rig floor 22, as shown in FIGS. 7 and 8. Particularly, in the embodiment shown in FIGS. 4-8, cylinders 169 of struts 168 may be actuated to rotate the directing frame 162 about pivot joint 166 to thereby transport equipment 182 until it is disposed over rig floor 22 (e.g., until equipment 182 is no longer horizontally spaced from rig floor 22) and lower equipment 184 onto rig floor 22, as shown in FIG. 8. In other embodiments, rotation of directing frame 162 via the actuation of cylinders 169 may place equipment 182 vertically over rig floor 22, and actuation of winch 176 may be used to vertically lower cable 178 until equipment 182 is placed or landed against rig floor 22. Furthermore, in the operating position 194 of crane unit 160 shown in FIG. 8, skate 140 of crane system 100 may be actuated to transport a tubular member (e.g., a pipe joint 32, etc.) from storage area 12 to the rig floor 22 with the first end 172A of crane 172 disposed vertically over rig floor 22.

The embodiment of crane system 100 shown in FIGS. 2-8 may be retracted to the various positions described above by reversing the actuation and order of the components and steps previously described. Thus, in some embodiments, crane system 100 provides a catwalk machine with an integrated or combined crane that extends from the adjustable directing frame to transport loads to and from the drill floor and to provide support to the catwalk skate for delivering drill pipe from a pipe storage area to a rig floor and back again.

Figure 11:
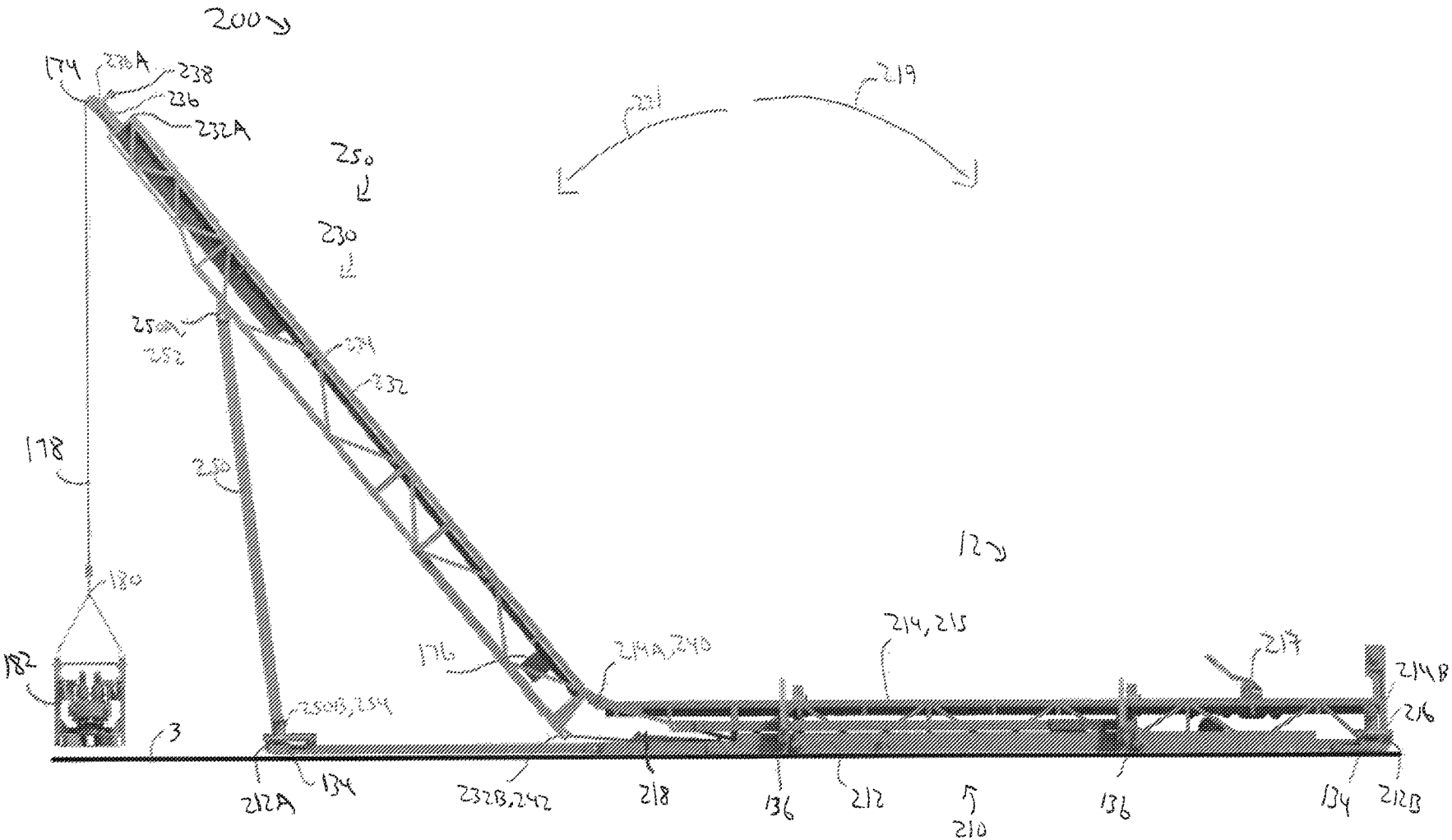
FIG. 11 is a side view of the catwalk and crane system of FIG. 10.

Referring to FIGS. 10 and 11, another embodiment of a tubular handling and transport system 200 (also referred to as a catwalk and crane system, or catwalk machine with crane) for use with the well system 10 of FIG. 1 is shown. Crane system 200 includes features in common with the crane system 100 shown in FIGS. 2-8 and shared features are labeled similarly. As with crane system 100 described above, crane system 200 is configured to provide the functionality of a catwalk machine and a lifting crane in a single transport system, thereby allowing for the transport of tubular members between a storage area and rig floor of a drilling rig and the lifting of equipment disposed at or near the surface to the rig floor.

In the embodiment shown in FIGS. 10 and 11, crane system 200 a catwalk unit 210 and crane unit 230. The catwalk unit 210 includes a substructure or support frame 212 with hydraulic moving feet 134 and support arms 136 and 138. Substructure 212 of catwalk unit 210 includes a first end 212A, a second end 212B longitudinally spaced from first end 212A. Additionally, catwalk unit 210 includes a pivotable tubular member or pipe support frame 214 having an upper or pipe support surface 215. Pipe support frame 214 has a first end 214A, a second end 214B longitudinally spaced form first end 214A, and an upper or pipe support surface 215 extending therebetween. Pipe support frame 214 is pivotally coupled with substructure 212 at a pivot joint 216 positioned at the second ends 212B and 214B of substructure 212 and pipe support frame 214, respectively. Additionally, a pipe transporter or catwalk ram or pusher 217 extends from support surface 215 and is configured to move longitudinally along support surface 215 when actuated via an actuator (not shown) to thereby transport a pipe or tubular member along support surface 215.

In the embodiment shown in FIGS. 10 and 11, crane unit 230 of crane system 200 includes a directing frame 232 having a first end 232A, a second end 232B longitudinally spaced from first end 232A, and an upper or pipe support surface 234 extending therebetween. Similar to the configuration of the crane unit 160 of crane system 100 described above, crane unit 230 also includes a telescopic member or crane 236 telescopically received in directing frame 232, where crane 236 is configured to telescopically extend and retract from the first end 232A of directing frame 232 in response to the actuation of a hydraulic cylinder or actuator (not shown) coupled to directing frame 232. Crane 236 has a first or outer end 236A that includes sheave 174 and a roller 238 for facilitating the transport of a tubular member along support surface 234 of directing frame 232. Similar to crane system 100, winch 176 is coupled to directing frame 232 proximal second end 232B. In some embodiments, support surface 215 comprises a first support surface 215 while support surface 234 comprises a second support surface 234.

The second end 232B of directing frame 232 is pivotally coupled to the first end 214A of pipe support frame 214 via a first or upper pivot joint 240. Additionally, in the embodiment shown in FIGS. 10 and 11, crane system 100 includes a pair of erecting cylinders or actuators 218 coupled to substructure 212 of crane unit 210. The second end 232B of directing frame 232 is pivotally coupled to each erecting cylinder 218 via a pair of second or lower pivot joints 242. Additionally, erecting cylinders 218 are coupled with pipe support frame 214 at a pair of third pivot joints 244 (shown in FIG. 14), where third pivot joints 244 are positioned proximal the first end 214A of pipe support frame 214. Thus, erecting cylinders 218 are coupled between the pipe support frame 214 and the directing frame 232. In this arrangement, extension of erecting cylinders 218 is configured to rotate directing frame 232 in a first rotational direction (indicated by arrow 219 in FIG. 11) about upper pivot joint 240 while retraction of erecting cylinders 218 is configured to rotate directing frame 232 in a second rotational direction (indicated by arrow 221 in FIG. 11) about upper pivot joint 240 opposite the first rotational direction 219. Particularly, extension of erecting cylinders 218 is configured to rotate directing frame 232 such that an angle formed between longitudinal axes of frames 232 and 214 is increased (e.g., the axes are closer to being orthogonal), while retraction of erecting cylinders 218 is configured to rotate directing frame 232 such that the angle formed between longitudinal axes of frames 232 and 214 is decreased (e.g., the axes are closer to being parallel).

In the embodiment shown in FIGS. 10 and 11, crane system 200 also includes a pivotable frame 250 having a first end 250A and a second end 250B longitudinally spaced from first end 250A. The first end 250A of pivotable frame 250 is pivotally coupled to directing frame 232 via a first pivot joint 252 located between or spaced from ends 232A and 232B of directing frame 232. The second end 250B of pivotable frame 250 is also pivotally coupled to substructure 212 via a second pivot joint 254 located at the first end 212A of substructure 212. In this arrangement, pivotable frame 250 is configured to restrict the movement of directing frame 232 such that retraction of erecting cylinders 218 results in rotation of pipe support frame 214 about pivot joint 216 in the first rotational direction 219, as will be discussed further herein.

Figure 12:
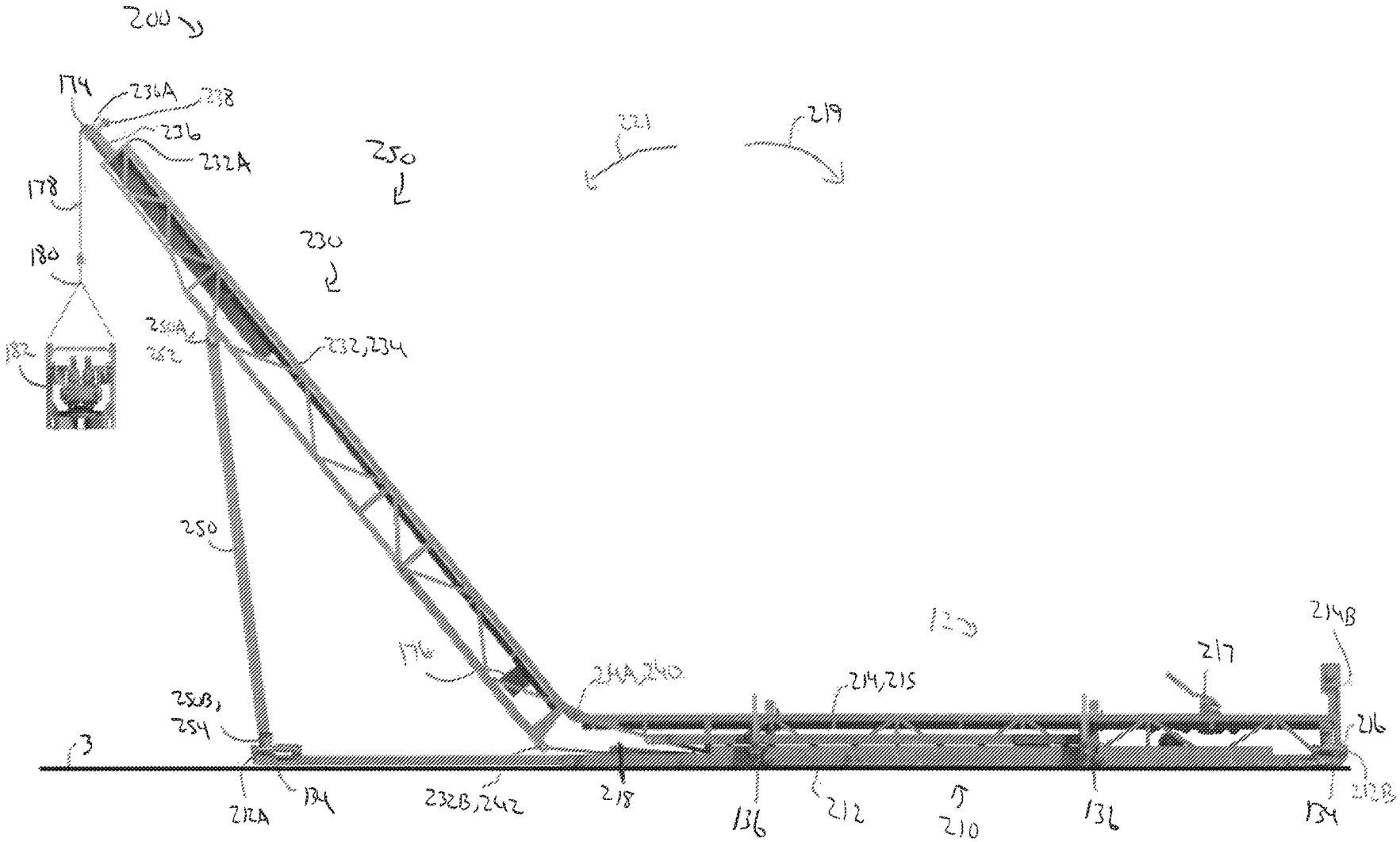
FIG. 12 is a side view of an operating position of the catwalk and crane system of FIG. 10.
Figure 13:
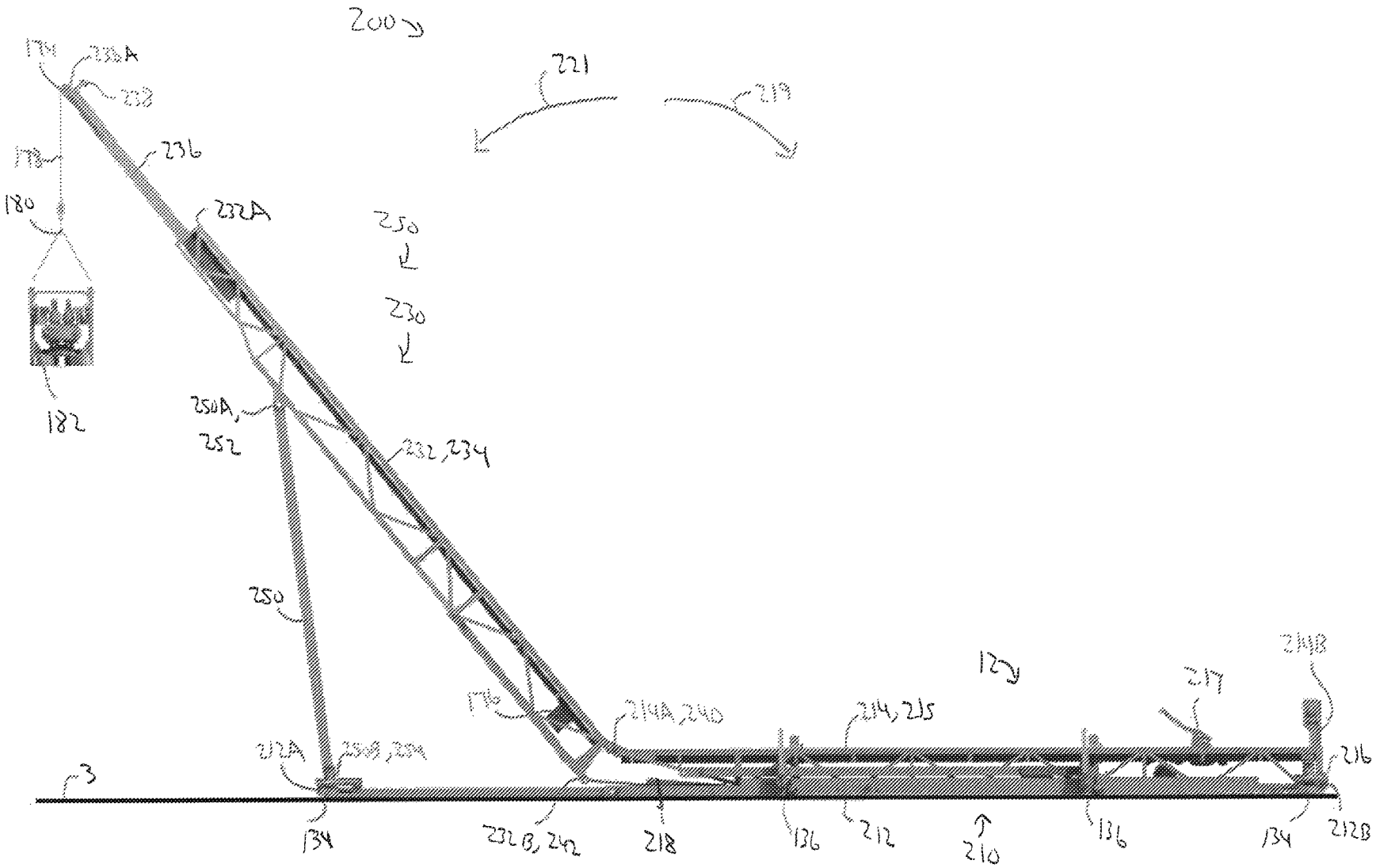
FIG. 13 is a side view of an extended position of a crane of the catwalk and crane system of FIG. 10.
Figure 14:
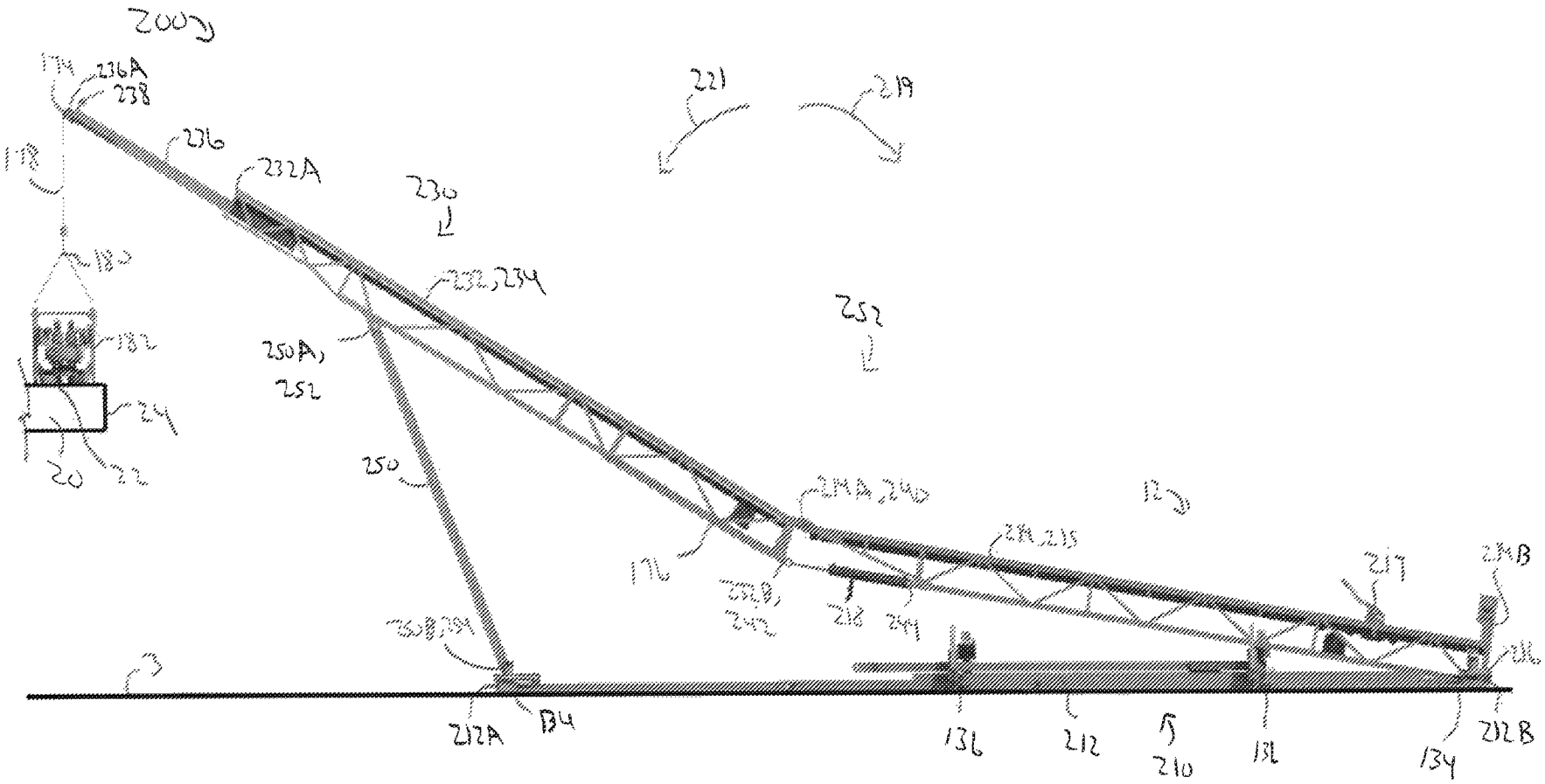
FIG. 14 is a side view of a transport position of the catwalk and crane system of FIG. 10.

Referring to FIGS. 12-14, crane system 200 is illustrated in FIGS. 12-14 transporting equipment 182 from a position at or near the surface 3 to the rig floor 22. Particularly, FIG. 12 illustrates crane unit 230 of crane system 200 in an operating position 250 with equipment 182 suspended from cable 178 and crane 236 in a retracted position within directing frame 232. As shown in FIG. 13, the first end 236A of crane 236 may be telescopically extended from directing frame 232 to transport equipment 182 both vertically and horizontally relative the surface 3 via a hydraulic cylinder similar to cylinder 173 of crane system 100.

As shown in FIG. 14, with crane 236 extended from directing frame 232 and equipment 182 suspended from cable 178, erecting cylinders 218 may be extended to pivot directing frame 232 and crane 236 in the second rotational direction 221 about first pivot joint 252, thereby reducing an angle formed between support surface 215 and support surface 234. In some embodiments, with crane system 200 in the position shown in FIG. 14, a tubular member driven or pushed by pusher 217 may be transported between support surface 215 and support surface 234 to transport the tubular member to the rig floor 22. Thus, the position of crane system 200 shown in FIG. 14 comprises a pipe transport position 252 configured to transport pipes or other tubular members between storage area 12 and the rig floor 22, whereas the position of crane system 200 shown in FIGS. 12 and 13 comprises a pipe loading position where pipe support frame 214 is configured to receive a pipe or other tubular member from the storage area 12. Additionally, the extension of erecting cylinders 218 transports equipment 182 horizontally relative surface 3 to dispose equipment 182 above rig floor 22 such that equipment 182 overhangs the side 24 of rig floor 22. Thus, by actuating crane system 200 into the transport position 252 from the loading position shown in FIGS. 12 and 13, equipment 182 is transported horizontally towards rig floor 22.

The embodiment of crane system 200 shown in FIGS. 10-14 may be retracted to the various positions described above by reversing the actuation and order of the components and steps previously described. Thus, in some embodiments, crane system 200 provides a catwalk machine with an integrated or combined crane that extends from the adjustable directing frame to transport loads to and from the drill floor and to provide support to the catwalk ram for delivering drill pipe from a pipe storage area to a rig floor and back again.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A catwalk and crane system for transporting equipment of a well system, comprising:
- a substructure;
- a directing frame pivotally coupled to the substructure;
- a pipe transporter configured to transport a tubular along the directing frame;
- a first actuator coupled to the directing frame and configured to rotate the directing frame relative to the substructure; and
- a crane coupled to the directing frame, wherein the crane is extendable from a first end of the directing frame, wherein in an extended position the crane is at a higher elevation than that of the pipe transporter.

2. The catwalk and crane system of claim 1, wherein the directing frame is rotatable, the crane is extendable, and the pipe transporter is moveable up the directing frame to deliver a tubular to and from a rig floor of the well system.

3. The catwalk and crane system of claim 1, further comprising:
- a winch coupled to a cable that is suspended from the crane;
- wherein the winch is configured to extend and retract the cable, and the cable is configured to physically support a suspended load.

4. The catwalk and crane system of claim 3, wherein, when the load is coupled with the cable, the directing frame is configured to transport the load both vertically and horizontally in response to the extension of the crane from the first end of the directing frame.

5. The catwalk and crane system of claim 4, further comprising a second actuator coupled to the directing frame and the crane, the second actuator configured to telescopically extend and retract the crane from the first end of the directing frame.

6. The catwalk and crane system of claim 3, wherein, when the load is coupled with the cable, the directing frame is configured to transport the load both vertically and horizontally in response to rotation of the directing frame relative to the substructure.

7. The catwalk and crane system of claim 1, wherein the pipe transporter comprises a catwalk skate configured to receive the tubular.

8. The catwalk and crane system of claim 7, wherein the catwalk skate comprises rollers and is displaceable between the substructure and the directing frame to transport the tubular.

9. A catwalk and crane system for transporting equipment of a well system, comprising:
- a substructure;
- a directing frame pivotally coupled to the substructure;
- a pipe transporter configured to transport a tubular along the directing frame;

a first actuator coupled to the directing frame and configured to rotate the directing frame relative to the substructure;

a crane coupled to the directing frame and extendable from the directing frame, wherein in an extended position the crane is at a higher elevation than that of the pipe transporter; and a winch coupled to a cable that is suspended from the crane.

10. The catwalk and crane system of claim 9, wherein the winch is configured to extend and retract the cable, and the cable is configured to physically support a suspended load.

11. The catwalk and crane system of claim 10, wherein, in response to actuation from the winch, the cable is configured to transport the load from a first position to a second position elevated from the first position.

12. The catwalk and crane system of claim 9, further comprising a sheave coupled to a first end of the crane, wherein the sheave is configured to support the cable.

13. The catwalk and crane system of claim 9, wherein the winch is coupled to the directing frame and rotatable with the directing frame relative to the substructure.

14. The catwalk and crane system of claim 9, wherein the first actuator is coupled between the directing frame and the substructure.

15. The catwalk and crane system of claim 9, further comprising:

a pipe support frame pivotally coupled to the substructure and to the directing frame;

wherein the actuator is coupled between the pipe support frame and the directing frame.

16. A catwalk and crane system for transporting equipment of a well system, comprising:

a substructure;

a pipe support frame pivotally coupled to the substructure;

a directing frame pivotally coupled to the pipe support frame;

a pipe transporter configured to transport a tubular member along the directing frame; and a crane coupled to the directing frame, wherein the crane is extendable from a first end of the directing frame, wherein in an extended position the crane is at a higher elevation than that of the pipe transporter.

17. The catwalk and crane system of claim 16, further comprising:

a winch coupled to a cable that is suspended from the crane;

wherein the winch is configured to extend and retract the cable, and the cable is configured to physically support a suspended load.

18. The catwalk and crane system of claim 16, wherein:

the pipe support frame comprises a first support surface;

the directing frame comprises a second support surface; and the pipe transporter comprises a ram configured to push the tubular member along the first support surface and the second support surface.

19. The catwalk and crane system of claim 18, further comprising:

a strut coupled between the directing frame and the substructure, wherein the strut is pivotally coupled to the directing frame at a pivot joint; and a first actuator coupled between the directing frame and the pipe support frame and configured to rotate the directing frame about the pivot joint relative to the strut.

20. The catwalk and crane system of claim 19, wherein the first actuator is configured to actuate the catwalk and crane system between a loading position configured to receive the tubular member, and a transport position configured to transport the tubular member between the first support surface and the second support surface.

* * * * *